US008903682B2

(12) United States Patent
Gyota et al.

(10) Patent No.: US 8,903,682 B2
(45) Date of Patent: Dec. 2, 2014

(54) AIR CONDITIONING SYSTEM DIAGNOSIS APPARATUS AND AIR CONDITIONING SYSTEM DIAGNOSIS RESULT DISPLAY APPARATUS

(75) Inventors: Tomoaki Gyota, Tokyo (JP); Noriyuki Kushiro, Tokyo (JP); Yoshiaki Ito, Tokyo (JP); Masanori Nakata, Tokyo (JP); Takeru Kuroiwa, Tokyo (JP)

(73) Assignee: Mitsubishi Electric Corporation, Chiyoda-Ku, Tokyo (JP)

( * ) Notice: Subject to any disclaimer, the term of this patent is extended or adjusted under 35 U.S.C. 154(b) by 400 days.

(21) Appl. No.: 13/376,458

(22) PCT Filed: Mar. 11, 2010

(86) PCT No.: PCT/JP2010/001725

§ 371 (c)(1),
(2), (4) Date: Dec. 6, 2011

(87) PCT Pub. No.: WO2010/143340

PCT Pub. Date: Dec. 16, 2010

(65) Prior Publication Data

US 2012/0101778 A1 Apr. 26, 2012

(30) Foreign Application Priority Data

Jun. 12, 2009 (JP) ..... 2009-141193

(51) Int. Cl.
*G06F 19/00* (2011.01)
*G05G 5/06* (2006.01)
*F24F 11/00* (2006.01)

(52) U.S. Cl.
CPC ..... *F24F 11/0086* (2013.01); *G05G 5/06* (2013.01); *F24F 2011/0091* (2013.01); *F24F 2011/0067* (2013.01)
USPC ..... 702/183; 62/127; 62/129

(58) Field of Classification Search
CPC ..... F24F 11/0086; F24F 2011/0091; F24F 2011/0067; G05G 5/06
USPC ..... 702/183; 62/125, 126, 127, 129, 130, 62/176.6; 236/84, 44 C; 165/11.1, 11.2, 165/251
See application file for complete search history.

(56) References Cited

U.S. PATENT DOCUMENTS 6,128,910 A * 10/2000 Faircloth ..... 62/129
7,146,290 B2 * 12/2006 Triginai et al. ..... 702/182

(Continued)

FOREIGN PATENT DOCUMENTS

JP 61-83836 A 4/1986
JP 4-263736 A 9/1992

(Continued)

OTHER PUBLICATIONS

Office Action (Notice of Reasons for Rejection) dated Oct. 23, 2012, issued in corresponding Japanese Patent Application No. 2011-518217, and an English Translation thereof. (5 pages).

(Continued)

*Primary Examiner* — Carol S Tsai
(74) *Attorney, Agent, or Firm* — Buchanan Ingersoll & Rooney

(57) ABSTRACT

An air conditioning system diagnosis apparatus and an air conditioning system diagnosis result display apparatus capable of representing various kinds of failures with high visibility by generating a system structure diagram that illustrates an air conditioning system in a different form depending on a detected failure and illustrating the failure using this system structure diagram are obtainable. Diagnosis result superimposed diagram generating means for generating a system structure diagram that includes icons, such as an icon of an outdoor unit and an icon of an indoor unit, and a line that links them on the basis of system structure information derived by system structure analyzing means and for superimposing a refrigeration cycle diagnosis result derived by refrigeration cycle analyzing means in the vicinity of an icon of a concerned device in the system structure diagram is included.

15 Claims, 17 Drawing Sheets

(56) References Cited

U.S. PATENT DOCUMENTS

| | | | | |
|---|---|---|---|---|
| 7,234,313 | B2 * | 6/2007 | Bell et al. | 62/129 |
| 7,243,054 | B2 * | 7/2007 | Rappaport et al. | 703/2 |
| 8,171,458 | B2 * | 5/2012 | Cheng et al. | 717/126 |
| 8,322,151 | B1 * | 12/2012 | Garofalo | 62/127 |
| 8,452,906 | B2 * | 5/2013 | Grohman | 710/105 |
| 8,463,442 | B2 * | 6/2013 | Curry et al. | 700/276 |
| 8,548,630 | B2 * | 10/2013 | Grohman | 700/276 |
| 8,560,125 | B2 * | 10/2013 | Wallaert et al. | 700/276 |
| 8,564,400 | B2 * | 10/2013 | Grohman et al. | 340/3.44 |
| 8,655,491 | B2 * | 2/2014 | Hadzidedic et al. | 700/276 |
| 2002/0198988 | A1 | 12/2002 | Hirose | |
| 2003/0229478 | A1 * | 12/2003 | Rappaport et al. | 703/13 |
| 2005/0258260 | A1 | 11/2005 | Ahmed | |
| 2005/0270151 | A1 | 12/2005 | Winick | |
| 2006/0052704 | A1 * | 3/2006 | Baba et al. | 600/453 |
| 2007/0012052 | A1 | 1/2007 | Butler et al. | |
| 2007/0228183 | A1 | 10/2007 | Kennedy et al. | |
| 2010/0102136 | A1 * | 4/2010 | Hadzidedic et al. | 236/49.3 |

FOREIGN PATENT DOCUMENTS

| | | | |
|---|---|---|---|
| JP | 2002-122345 | A | 4/2002 |
| JP | 2003-006063 | A | 1/2003 |
| JP | 2007-046822 | A | 2/2007 |
| JP | 2007-127304 | A | 5/2007 |
| JP | 2008-283259 | A | 11/2008 |
| WO | WO 2009/096299 | A1 | 8/2009 |

OTHER PUBLICATIONS

International Search Report (PCT/ISA/210) issued on Jun. 8, 2010, by Japanese Patent Office as the International Searching Authority for International Application No. PCT/JP2010/001725.

Extended European Search Report dated Feb. 25, 2014, issued by the European Patent Office in corresponding European Patent Application No. 10785872.2-1602 / 2442042. (6 pages).

Jul. 28, 2014 Chinese Office Action issued in Chinese Patent Application No. 201080025825.9 (with English language translation).

* cited by examiner

FIG. 8

| TEMPLATE TYPE | PACKET POSITION | CRITERION VALUE | WEIGHT |
|---|---|---|---|
| NORMAL | 1 | 0xAA | 10 |
| NORMAL | 3 | SAME VALUE AS MESSAGE LENGTH | 6 |
| ABNORMAL | 1 | 0xCC | 1 |
| ABNORMAL | LAST | 0x00～0x02 | 3 |
| : | : | : | : |

400
401
402
403

AIR CONDITIONING SYSTEM DIAGNOSIS APPARATUS AND AIR CONDITIONING SYSTEM DIAGNOSIS RESULT DISPLAY APPARATUS

TECHNICAL FIELD

The present invention relates to an air conditioning system diagnosis apparatus and an air conditioning system diagnosis result display apparatus that perform a diagnosis on an air conditioning system in which a plurality of air conditioners are connected by a refrigerant pipeline and a general-purpose network and that display a result of the diagnosis.

BACKGROUND ART

An air conditioner installation work support apparatus that detects a failure by comparing information on a refrigerant structure or a type of an air conditioning system with information at design or installation time and represents the failure using a diagram illustrating a device configuration of the air conditioning system (hereinafter referred to as system structure diagram) is proposed (see, for example, Patent Literature 1).

As for this system structure diagram, a centralized control apparatus for an air conditioning system that automatically acquires a device configuration and generates the system structure diagram by inquiring of an outdoor unit connected to each indoor unit or a remote controller is proposed (see, for example, Patent Literature 2).

CITATION LIST

Patent Literature

Patent Literature 1: Japanese Unexamined Patent Application Publication No. 2007-46822 (pp. 20-21, FIG. 20)

Patent Literature 2: Japanese Unexamined Patent Application Publication No. 2002-122345 (pp. 1-2, FIG. 1)

SUMMARY OF INVENTION

Technical Problem

However, a diagnosis apparatus that comprehensively handles failures of an air conditioning system is required to represent various failures, including a failure relating to a network connecting devices and a failure relating to a refrigeration cycle produced in an air conditioner. Thus it is necessary to depict various kinds of information, including a device configuration, a communication relation, and a refrigerant structure, in a system structure diagram, and the complexity of the system structure diagram raises an issue in that visibility of the failure decreases.

The present invention is made to solve the above-described problems, and it is an object thereof to provide an air conditioning system diagnosis apparatus and an air conditioning system diagnosis result display apparatus capable of representing various failures with high visibility by generating a system structure diagram that illustrates an air conditioning system in a different form depending on a detected failure and illustrating the failure using this system structure diagram.

Solution to Problem

An air conditioning system diagnosis apparatus according to the present invention includes communication means for, in an air conditioning system in which a plurality of devices are connected by a network and the related devices transmit and receive a control signal or like to and from each other over the network, performing communication between the devices over the network, device type identifying means for indentifying a device type that indicates a type of each device, communication list generating means for generating a communication list that includes a combination of the devices being a communication source and a communication destination of the control signal or the like, system structure analyzing means for deriving system structure information that indicates a device configuration of the air conditioning system from the device type and the communication list, system diagnosis means for performing a diagnosis on the air conditioning system using information acquired through the communication means and deriving a diagnosis result, diagnosis result superimposed diagram generating means for generating a system structure diagram on the basis of the system structure information acquired from the system structure analyzing means and superimposing an highlighted content of the diagnosis result in the system structure diagram, and a display unit that acquires the system structure diagram in which the content of the diagnosis result is superimposed from the diagnosis result superimposed diagram generating means and displaying the system structure diagram.

Advantageous Effects of Invention

With the air conditioning system diagnosis apparatus according to the present invention, because it displays a system structure diagram that illustrates an air conditioning system such that a diagnosis result for the air conditioning system is superimposed therein, correspondence between that diagnosis result and the air conditioning system can be easily identified visually and thus action against a failure can be promptly carried out, so the failure can be overcome early.

BRIEF DESCRIPTION OF DRAWINGS

FIG. 8 illustrates an example of a normal template and an abnormal template for use in deriving the degree of similarity to a communication message.

DESCRIPTION OF EMBODIMENTS

Embodiment 1

(Configuration of Air Conditioning System Diagnosis Apparatus 100)

Figure 1:
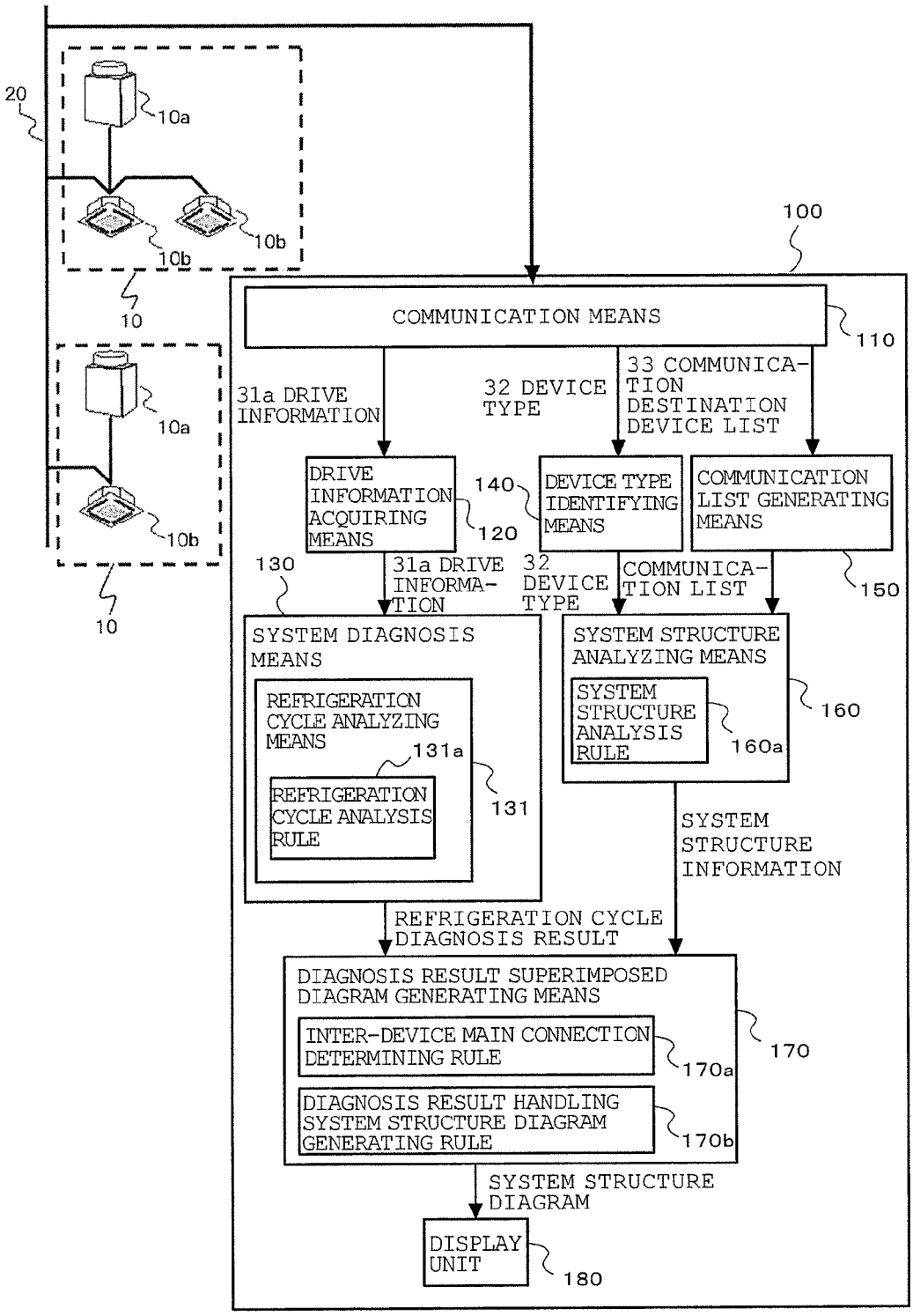
FIG. 1 illustrates an inner block of an air conditioning system diagnosis apparatus 100 and a general configuration of an air conditioning system according to Embodiment 1 of the present invention.

FIG. 1 illustrates an inner block of the air conditioning system diagnosis apparatus 100 and a general configuration of an air conditioning system according to Embodiment 1 of the present invention.

As illustrated in FIG. 1, a plurality of air conditioners 10 each including at least outdoor unit 10*a* and one or more indoor units 10*b* are connected to a network 20. The air conditioning system diagnosis apparatus 100 for performing a diagnosis of a failure in an air conditioning system is connected to the network 20.

FIG. 1 illustrates a configuration in which the plurality of air conditioners 10 is connected to the network 20. However, the present embodiment is not limited to this configuration. A configuration in which a single air conditioner 10 is connected may also be used.

The air conditioning system diagnosis apparatus 100 includes at least component groups (1) to (4) described below.

(1) A component group that acquires data flowing in the network 20

(2) A component group that performs a diagnosis of a state of an air conditioning system (3) A component group that analyzes a system structure of an air conditioning system (4) A component group that displays both a diagnosis result in (2) and a system structure in (3)

The above component groups (1) to (4) include component groups described below.

(1) A component group that acquires data, flowing in the network 20

This includes communication means 110 connected to the network 20 and being for transmitting and receiving data through the network 20.

(2) A component group that performs a diagnosis of a state of an air conditioning system The component group (2) includes drive information acquiring means 120 for acquiring drive information 31*a* (described below in the description of FIG. 2) retained in the outdoor unit 10*a* or indoor unit 10*b* included in the air conditioner 10 through the network 20 and the communication means 110. The component group (2) further includes system diagnosis means 130 for performing a diagnosis of a state of an air conditioning system on the basis of the drive information 31*a* acquired by this drive information acquiring means 120.

The system diagnosis means 130 includes refrigeration cycle analyzing means 131 for performing a diagnosis of a state of a refrigeration cycle in an air conditioning system on the basis of the acquired drive information 31 a and deriving a refrigeration cycle diagnosis result (described below in the description of FIG. 3). The refrigeration cycle analyzing means 131 retains a refrigeration cycle analysis rule 131*a* for use in deriving the above refrigeration cycle diagnosis result.

(3) A component group that analyzes a system structure of an air conditioning system The component group (3) includes device type indentifying means 140 for acquiring a device type 32 (described below in the description of FIG. 2) retained in the outdoor unit 10*a* or indoor unit 10*b* included in the air conditioner 10 through the network 20 and the communication means 110. The component group (3) also includes communication list generating means 150 for acquiring a communication destination device list 33 (described below in the description of FIG. 2) retained in the outdoor unit 10*a* or indoor unit 10*b* included in the air conditioner 10 through the network 20 and the communication means 110. The component group (3) further includes system structure analyzing means 160 for deriving system structure information (described below in the description of FIG. 3) containing a refrigerant structure, an interlocking relation of the air conditioning system and the like on the basis of the device type 32 acquired by the above device type indentifying means 140 and a communication list (described below in the description of FIG. 3) generated by the communication list generating means 150.

The system structure analyzing means 160 retains a system structure analysis rule 160*a* for use in deriving the system structure information.

(4) A component group that displays both a diagnosis result in (2) and a system structure in (3)

The component group (4) includes diagnosis result superimposed diagram generating means 170 for generating a system structure diagram (described below in the description of FIG. 3) including icons, such as an icon of the outdoor unit 10*a* and an icon of the indoor unit 10*b*, and lines that link them on the basis of system structure information derived by the system structure analyzing means 160 and superimposing a refrigeration cycle diagnosis result derived by the refrigeration cycle analyzing means 131 in the vicinity of an icon of a related device in the system structure diagram. The component group (4) further includes a display unit 180 for displaying the system structure diagram in which the content of the refrigeration cycle diagnosis result is superimposed.

The diagnosis result superimposed diagram generating means 170 retains an inter-device main connection determining rule 170*a* and a diagnosis result handling system structure diagram generating rule 170*b* for use in generating a system structure diagram.

Figure 2:
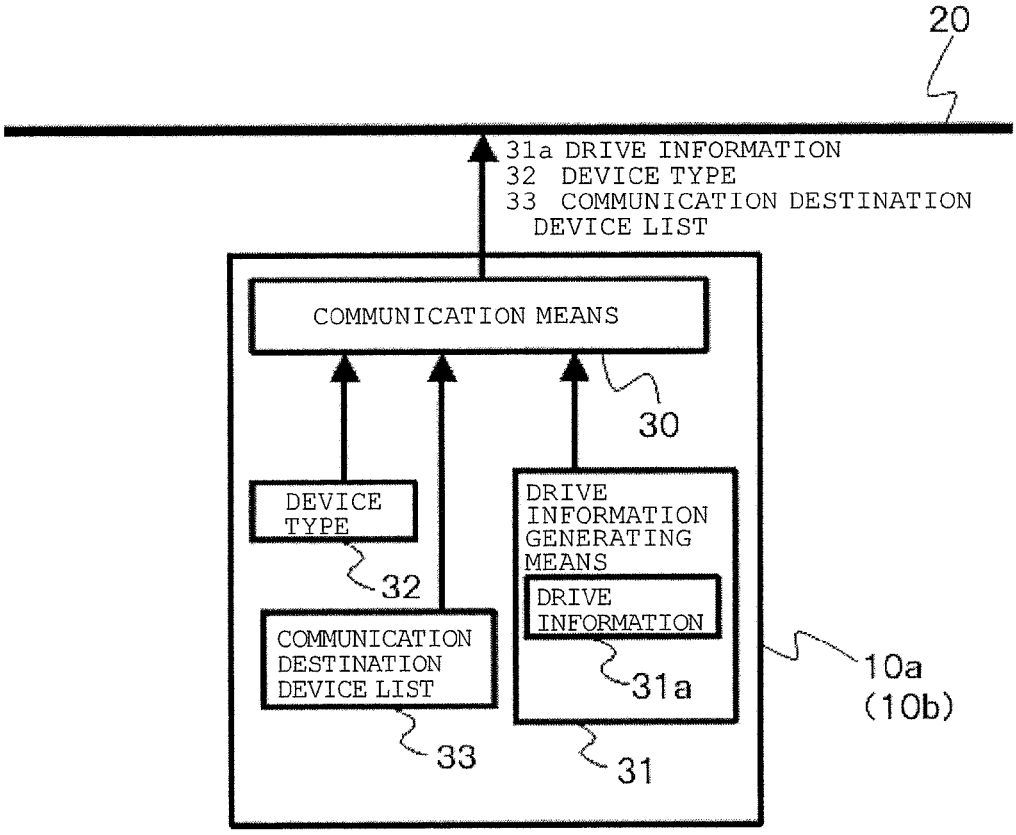
FIG. 2 is an inner block diagram of an outdoor unit 10*a* and an indoor unit 10*b* in the air conditioning system according to Embodiment 1 of the present invention.

FIG. 2 is an inner block diagram of the outdoor unit 10*a* and the indoor unit 10*b* in the air conditioning system according to Embodiment 1 of the present invention.

As illustrated in FIG. 2, the outdoor unit 10*a* and indoor unit 10*b* include communication means 30 being connected to the network 20 and being for transmitting and receiving data from the network 20. The outdoor unit 10*a* and indoor unit 10*b* also include drive information generating means 31 for generating the drive information 31*a*, for example, a refrigerant temperature value or a refrigerant pressure value, The outdoor unit 10*a* and indoor unit 10*b* retain the device type 32 indicating the kind of the device, function thereof or the like and the communication destination device list 33 being a list of communication destinations of a control signal or the like.

The communication means 30 sends the drive information 31*a* generated by the drive information generating means 31, the device type 32, and the communication destination device list 33 to the network 20.

The outdoor unit 10*a* and indoor unit 10*b* have been described as having the configuration illustrated in FIG. 2. However, not all of the outdoor units 10*a* and indoor units 10*b* included in the air conditioning system may have the configuration illustrated in FIG. 2. For example, only an outdoor unit 10*a* or indoor unit 10*b* required to be a diagnosis target may have the configuration illustrated in FIG. 2.

The configuration illustrated in FIG. 2 has been described as being included in the outdoor unit 10*a* and indoor unit 10*b*. However, a device other than the outdoor unit 10*a* and indoor unit 10*b*, for example, a refrigerant shunt apparatus for shunting a refrigerant circuit included in the air conditioning system or another device, such as a remote controller, may have the configuration illustrated in FIG. 2 and may send the drive information 31*a*, the device type 32, or the communication destination device list 33 to the network 20.

A configuration in which the drive information acquiring means 120, system diagnosis means 130, device type indentifying means 140, communication list generating means 150, system structure analyzing means 160, or diagnosis result superimposed diagram generating means 170 is achieved by hardware, such as a circuit device, may be used, or alternatively, a configuration in which it is achieved as software executed by an arithmetic unit, such as a microcomputer or a central processing unit (CPU), may be used.

Additionally, a configuration in which the refrigeration cycle analysis rule 131*a*, system structure analysis rule 160*a*, inter-device main connection determining rule 170*a*, or diagnosis result handling system structure diagram generating rule 170*b* is achieved by logic on software may be used, or alternatively, a configuration in which it is achieved by a circuit device equivalent thereto or the like may be used.

(Overview of Operation of Air Conditioning System Diagnosis Apparatus 100)

Figure 3:
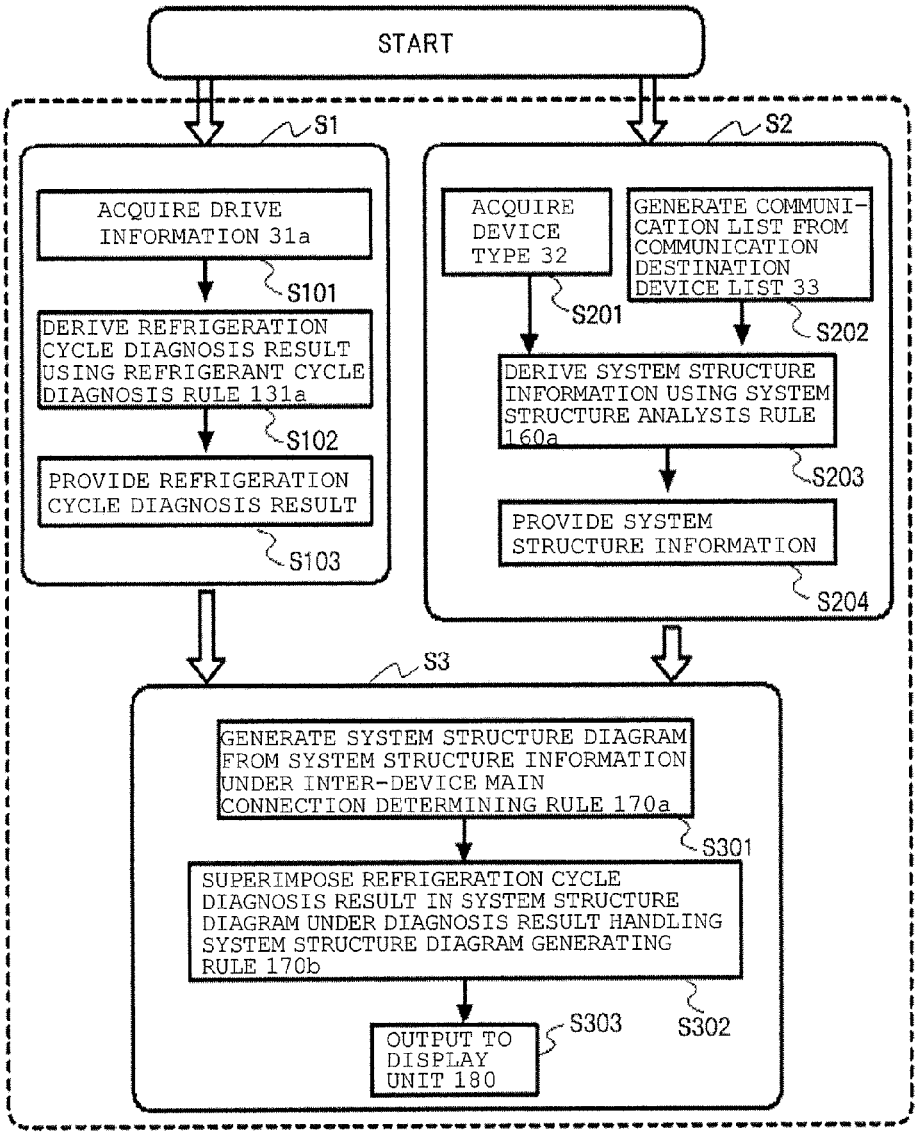
FIG. 3 is a flowchart of processing performed by the air conditioning system diagnosis apparatus 100 according to Embodiment 1 of the present invention.

FIG. 3 is a flowchart of processing performed by the air conditioning system diagnosis apparatus 100 according to Embodiment 1 of the present invention. An operation of the air conditioning system diagnosis apparatus 100 is described below with reference to FIG. 3.

Processing performed by the air conditioning system diagnosis apparatus 100 according to the present embodiment can be broadly classified into step S1 to step S3 described below.

(S1) System Diagnosis Step

The drive information acquiring means 120 acquires the drive information 31*a* from the air conditioner 10 through the network 20 and the communication means 110. The refrigeration cycle analyzing means 131 of the system diagnosis means 130 performs a diagnosis of a refrigeration cycle in the air conditioning system on the basis of that drive information 31*a* and derives a refrigeration cycle diagnosis result that indicates the presence or absence of a failure or the like.

(S2) System Structure Analyzing Step

The device type indentifying means 140 acquires the device type 32 from the air conditioner 10 or the like through the network 20 and the communication means 110. The communication list generating means 150 acquires the communication destination device list 33 from the air conditioner 10 or the like through the network 20 and the communication means 110 and generates a communication list on the basis of that communication destination device list 33. The system structure analyzing means 160 derives system structure information containing a refrigerant structure and an interlocking relation of the air conditioning system and the like on the basis of the device type 32 and the communication list.

(S3) Diagnosis Result System Structure Diagram Superimposing and Displaying Step The diagnosis result superimposed diagram generating means 170 generates a system structure diagram on the basis of the system structure information derived by the system structure analyzing means 160, superimposes the content of the refrigeration cycle diagnosis result derived by the refrigeration cycle analyzing means 131 in the vicinity of an icon of a related device in the system structure diagram, and outputs that system structure diagram in which the content of the refrigeration cycle diagnosis result is superimposed to the display unit 180.

The details of the operations in step S1 to step S3 in FIG. 3 are described below for each step.

(Overview of Operation in System Diagnosis Step S1)

The details of an operation of step S1 are described below with reference to FIG. 3.

(S101)

The drive information generating means 31 in the outdoor unit 10*a* or indoor unit 10*b* included in the air conditioner 10 generates the drive information 31*a* at regular intervals and sends that drive information 31*a* to the network 20 through the communication means 30. The drive information acquiring means 120 in the air conditioning system diagnosis apparatus 100 acquires that drive information 31*a* through the communication means 110 and informs the system diagnosis means 130 of the drive information 31*a*. An interval for sending of the drive information 31*a* generated by the drive information generating means 31 to the network 20 described above can be 30 seconds, for example.

The drive information 31 a may be accumulated by the outdoor unit 10*a* or indoor unit 10*b* at regular intervals, and the accumulated drive information 31*a* may be collectively transmitted to the drive information acquiring means 120. Alternatively, the outdoor unit 10*a* or indoor unit 10*b* may hold only momentary drive information 31*a*, and the drive information acquiring means 120 may acquire and accumulate the drive information 31*a* at regular intervals.

In the foregoing, an operation of sending the drive information 31*a* by the drive information generating means 31 to the network 20 at regular intervals is used. However, the present embodiment is not limited to this operation. An operation of transmitting a signal for instructing the drive information generating means 31 to send the drive information 31*a* at regular intervals, causing the drive information generating means 31 to send the drive information 31*a* to the network 20, and acquiring that drive information 31*a* by the drive information acquiring means 120 may be used.

(S102)

The refrigeration cycle analyzing means 131 in the system diagnosis means 130 sequentially derives, from the drive information 31*a* informed by the drive information acquiring means 120, refrigeration cycle diagnosis results containing information that indicates the presence or absence of a failure in a state of a refrigeration cycle in the air conditioner 10, such as anomalous of a refrigerant temperature, anomalous of refrigerant pressure, excess or deficiency of the amount of refrigerant, or a breakdown of a refrigerant control valve, under the refrigeration cycle analysis rule 131*a*.

Here, the refrigeration cycle analysis rule 131*a* is a rule for determining whether there is a failure in a refrigeration cycle that establishes a refrigerant structure in an air conditioning system. For example, when the drive information 31*a* contains a refrigerant temperature value, a refrigerant pressure value, or the like and the refrigeration cycle analysis rule 131*a* has an abnormal threshold, if that refrigerant temperature value, refrigerant pressure value, or the like exceeds the abnormal threshold, it may be determined that the refrigeration cycle diagnosis result is "abnormal." For example, in the case of a configuration in which the air conditioning system diagnosis apparatus 100 includes previous drive information storage means (not illustrated) for storing drive information at past inspection or the like of a specified refrigeration cycle in an air conditioning system being a diagnosis target (hereinafter referred to as previous drive information), when the refrigeration cycle analyzing means 131 compares the drive information 31*a* with the previous drive information, if the increase and decrease pattern of the refrigerant temperature value, or refrigerant pressure value, or the like is the same as or similar to the increase and decrease pattern occurring when the refrigerant reduces possessed in the refrigeration cycle analysis rule 131*a*, it may be determined that the refrigeration cycle diagnosis result is "abnormal."

(S103)

The system diagnosis means 130 informs the diagnosis result superimposed diagram generating means 170 of the refrigeration cycle diagnosis result derived by the refrigeration cycle analyzing means 131.

(Overview of Operation in System Structure Analyzing Step S2)

The details of an operation of step S2 are described below with reference to FIG. 3.

(S201)

The device type indentifying means 140 acquires the device type 32 retained in the outdoor unit 10*a*, indoor unit 10*b*, refrigerant shunt apparatus (not illustrated), remote controller (not illustrated), or the like through the communication means 110 and informs the system structure analyzing means 160 of the device type 32.

Here, the device type 32 is information that indicates a role of each of the outdoor unit 10*a*, indoor unit 10*b*, refrigerant shunt apparatus, remote controller, and the like in the air conditioning system.

(S202)

The communication list generating means 150 acquires the communication destination device list 33 retained in the outdoor unit 10*a*, indoor unit 10*b*, refrigerant shunt apparatus (not illustrated), or remote controller (not illustrated) through the communication means 110, generates a communication list on the basis of that communication destination device list 33, and informs the system structure analyzing means 160 of the communication list.

Here, the communication list can be a list of combinations of source devices and destination devices, for example.

(S203)

The system structure analyzing means 160 derives system structure information containing a refrigerant structure that indicates the indoor units 10*b* and the like connected from the same outdoor unit 10*a* by a refrigerant pipeline, an interlocking relation that indicates the indoor units 10*b* and the like operating in conjunction with each other at remote control, and the like from the device type 32 acquired from the device type indentifying means 140 and the communication list acquired from the communication list generating means 150 under the system structure analysis rule 160*a*.

Here, the system structure analysis rule 160*a* is a rule for identifying a relation between devices, such as the outdoor unit 10*a*, indoor unit 10*b*, refrigerant shunt apparatus, remote controller, and the like, included in an air conditioning system. For example, if an air conditioning system includes a plurality of outdoor units 10*a* and a plurality of indoor units 10*b* and the communication list has a combination of the outdoor units 10*a* and indoor units 10*b*, an outdoor unit 10*a* and an indoor unit 10*b* in combination may be identified as belonging to the same refrigerant structure. If the communication list has a plurality of combinations with different indoor units 10*b* for a single remote controller, these indoor units 10*b* may be identified as being in an interlocking relation.

(S204)

The system structure analyzing means 160 informs the diagnosis result superimposed diagram generating means 170 of the derived system structure information.

(Overview of Operation in Diagnosis Result System Structure Diagram Superimposing and Displaying Step S3)

Figure 4:
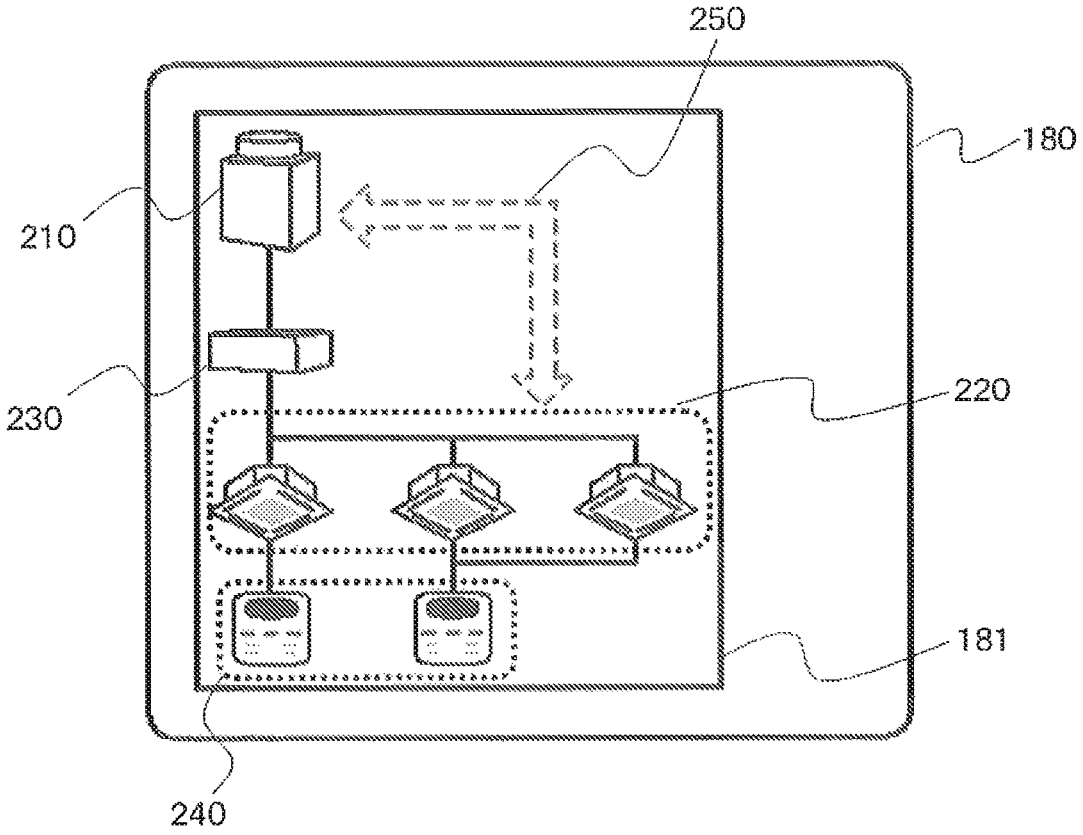
FIG. 4 illustrates a system structure diagram in which main devices are linked by lines, the system structure diagram being displayed on a display panel 181 of the air conditioning system diagnosis apparatus 100 according to Embodiment 1 of the present invention.
Figure 5:
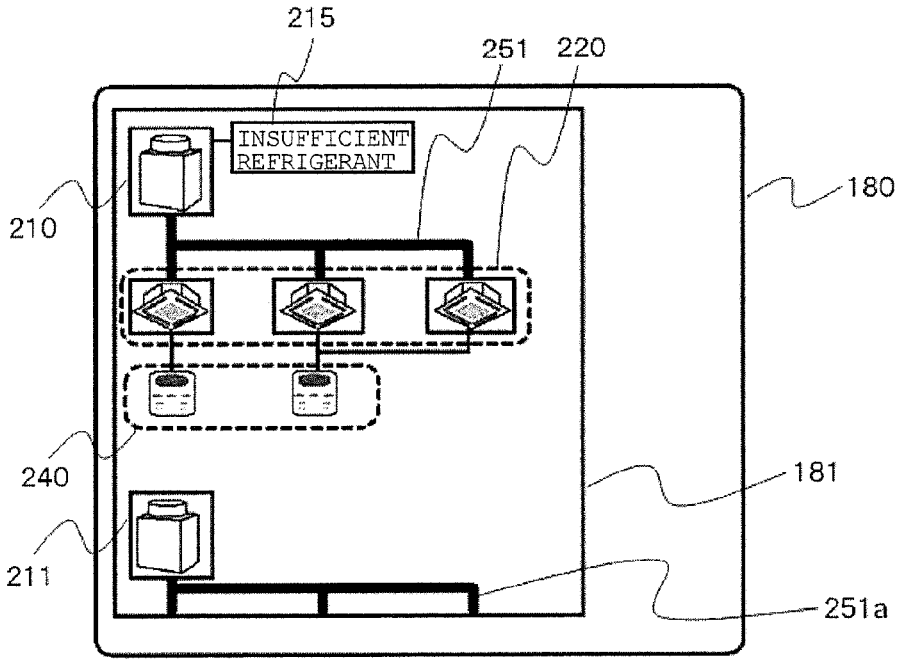
FIG. 5 is an illustration in which a refrigerant structure that connects devices is highlighted, the illustration being displayed on the display panel 181.

FIG. 4 illustrates a system structure diagram in which main devices are linked by lines, the system structure diagram being displayed on a display panel 181 of the air conditioning system diagnosis apparatus 100 according to Embodiment 1 of the present invention. FIG. 5 is an illustration in which a refrigerant structure that connects devices is highlighted, the illustration being displayed on the display panel 181. The details of an operation of step S3 are described below with reference to FIGS. 3 to 5.

(S301)

The diagnosis result superimposed diagram generating means 170 generates a system structure diagram that includes icons of devices and lines linking them from the system structure information under the inter-device main connection determining rule 170*a*. For example, as illustrated in FIG. 4, which illustrates a system structure diagram displayed on the display panel 181 of the display unit 180 in step S303 described below, the system structure diagram is illustrated using icons that indicate device types of devices included in the air conditioning system in a distinguishable manner. As illustrated in this FIG. 4, the diagnosis result superimposed diagram generating means 170 generates the system structure diagram in which main devices determined from devices between which a control signal or the like is transmitted and received under the inter-device main connection determining rule 170*a* are linked by lines. Under this inter-device main connection determining rule 170*a*, for example, if the outdoor unit 10*a*, refrigerant shunt apparatus (not illustrated), indoor units 10*b*, and remote controllers (not illustrated) are connected with each other, it is determined that connection relations between the outdoor unit 10*a* and the refrigerant shunt apparatus, between the refrigerant shunt apparatus and the indoor units 10*b*, and between the indoor units 10*b* and the remote controllers are main connection relations, and they are illustrated such that an outdoor unit icon 210 indicating the outdoor unit 10*a* and a refrigerant shunt apparatus icon 230 indicating the refrigerant shunt apparatus, the refrigerant shunt apparatus icon 230 and indoor unit icons 220 indicating the indoor units 10*b*, and the indoor unit icons 220 and remote controller icons 240 indicating the remote controllers are linked to each other by connection lines. It is determined that a connection relation between the outdoor unit 10*a* and the indoor units 10*b* is a not-main connection relation, and a connection line 250 between the outdoor unit icon 210 and the indoor unit icons 220 is omitted.

FIG. 4 illustrates merely an example of the system structure diagram and is not intended to limit Embodiment 1.

(S302)

The diagnosis result superimposed diagram generating means 170 superimposes the content of the refrigeration cycle diagnosis result informed by the system diagnosis means 130 in the vicinity of a device or a group of devices related with the refrigeration cycle diagnosis result in the generated system structure diagram under the diagnosis result handling system structure diagram generating rule 170*b*. For example, if the refrigeration cycle diagnosis result contains information indicating detection of a failure in the refrigeration cycle, as illustrated in FIG. 5, which illustrates a system structure diagram displayed on the display panel 181 of the display unit 180 in step S303 described below, information on the indoor units 10*b* and outdoor unit 10*a* forming the refrigeration cycle and the refrigerant structure thereof is extracted from the system structure information, and the system structure diagram is generated in which the indoor unit icons 220 and outdoor unit icons 210 and 211, which are the icons corresponding to the above devices, and connection lines 251 and 251*a* connecting them are highlighted and superimposed, and with respect to these, highlights on items in which a failure occurs, for example, an indoor unit 10*b* and an outdoor unit 10*a* in which a failure has been detected, an indoor unit 10*b* and an outdoor unit 10*a* being linked by the same refrigerant pipeline, and the refrigerant pipeline linking them is superimposed and illustrated.

For example, in FIG. 5, when an insufficient refrigerant occurs in a specified outdoor unit 10*a*, an insufficient refrigerant displaying section 215 superimposed on the outdoor unit icon 210 corresponding to that outdoor unit 10*a* is illustrated.

In the foregoing, an operation of highlighting and illustrating a connection line or a device in which a failure occurs is used. However, the present embodiment is not limited to this operation. An operation of highlighting and illustrating all of the devices and connection lines existing in a target air conditioning system may also be used.

FIG. 5 illustrates merely an example of the system structure diagram and is not intended to limit Embodiment 1.

(S303)

Then the diagnosis result superimposed diagram generating means 170 outputs the system structure diagram generated from the system structure information in step S301 and in which the content of the refrigeration cycle diagnosis result is superimposed in step S302 to the display unit 180. When receiving the system structure diagram, the display unit 180 displays that system structure diagram on the display panel 181.

(Advantageous Effects in Embodiment 1)

With the above-described configuration and operations, because a system structure diagram illustrating an air conditioning system in which a refrigeration cycle diagnosis result is superimposed is displayed, correspondence between the refrigeration cycle diagnosis result and the air conditioning system can be easily identified visually. This facilitates a user to promptly deaf with a failure and to early eliminate the failure.

In the air conditioning system in which each of the devices, such as the outdoor unit 10*a*, indoor unit 10*b*, refrigerant shunt apparatus, and remote controller, retains the device type 32, the device type indentifying means 140 of the air conditioning system diagnosis apparatus 100 sequentially asks these devices their respective device types and identifies them, thus enabling system structure information to be promptly and fully generated and a refrigeration cycle diagnosis result to be displayed.

In the air conditioning system in which each of the devices, such as the outdoor unit 10*a*, indoor unit 10*b*, refrigerant shunt apparatus, and remote controller, retains the communication destination device list 33, the communication list generating means 150 of the air conditioning system diagnosis apparatus 100 sequentially asks these devices and generates a communication list, thus enabling system structure information to be promptly and fully generated and a refrigeration cycle diagnosis result to be displayed.

Displaying a system structure diagram that illustrates all the devices and only main connection relations can reduce complexity of the system structure diagram and allows the device configuration of the air conditioning system to be easily visible.

In the air conditioning system in which each of the devices, such as the outdoor unit 10*a*, indoor unit 10*b*, and refrigerant shunt apparatus retains the drive information 31*a*, the drive information acquiring means of the air conditioning system diagnosis apparatus 100 sequentially asks these devices and acquires the drive information 31*a*, and the system diagnosis means 130 analyzes a refrigeration cycle on the basis of that drive information 31*a*, thus enabling a failure relating to the refrigeration cycle to be detected and displayed in a refrigeration cycle diagnosis result.

If the air conditioning system diagnosis apparatus 100 retains previous drive information, analyzing a refrigeration cycle using the acquired drive information 31*a* and previous drive information can detect a failure relating to the refrigeration cycle caused by deterioration over time in the air conditioning system, such as refrigerant leakage, and display it in a refrigeration cycle diagnosis result.

If a failure of a refrigeration cycle is found in a refrigeration cycle diagnosis result, generating a diagram in which the outdoor unit 10*a*, indoor unit 10*b*, refrigerant shunt apparatus, or the like and their connection lines are highlighted as a system structure diagram allows the relation between the devices forming the refrigeration cycle in the system structure diagram and their connection relations and refrigeration cycle diagnosis result to be easily visible.

Figure 6:
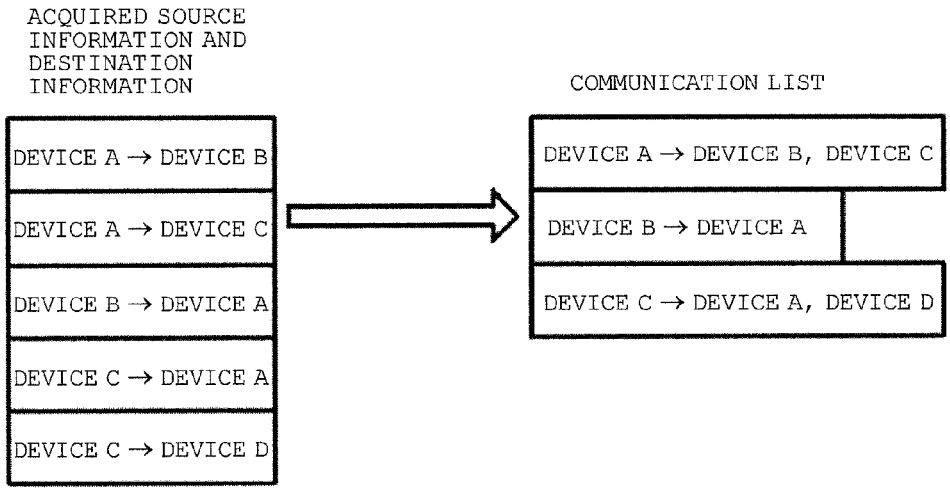
FIG. 6 illustrates an operation of generating a communication list on the basis of source information and destination information of communication.

For the present embodiment, the communication list generating means 150 acquires the communication destination device lists 33 retained in the devices included in the air conditioning system through the communication means 110 and generates a communication list in which they are integrated. However, the present embodiment is not limited to this operation. As illustrated in FIG. 6, a communication list may also be generated on the basis of source information and destination information of communication acquired by the communication means 110. With such an operation, communications for acquiring the communication destination device list 33 retained in each of the devices are not necessary, so the communication list generating means 150 can generate the communication list without imposing heavy load on the network 20 and the devices, and even if the network 20 or each device is under heavy load, the system structure analyzing means 160 can generate system structure information.

For the present embodiment, the device type indentifying means 140 acquires the device type 32 retained in each of the device included in the air conditioning system through the communication means 110. However, the present embodiment is not limited to this operation. The device type indentifying means 140 may also acquire a communication list from the communication list generating means 150 and estimate the device type 32 on the basis of that communication list and a combination of frequencies of communications indicated in that communication list. For example, in the case of a device group that performs one-to-many communications, a side of "one" is assumed as the outdoor unit 10*a*, a side of "many" is assumed as the indoor units 10*b*, and a device that frequently performs one-to-one communications with any one of the indoor units 10*b* is assumed as the remote controller. With such an operation, communications for acquiring the device type 32 retained in each device are not necessary, so the device type indentifying means 140 can estimate the device type 32 without imposing heavy load on the network 20 and each device, and even if the network 20 or each device is under heavy load, the system structure analyzing means 160 can generate system structure information.

For the present embodiment, the device type indentifying means 140 acquires the device type 32 retained in each of the devices included in the air conditioning system through the communication means 110. However, the present embodiment is not limited to this operation. The device type indentifying means 140 may acquire a communication list from the communication list generating means 150 and estimate the device type 32 from the communication list and the content of a communication message acquired from the network 20 through the communication means 110. For example, the source of communication of a drive stop command is assumed as the remote controller, its destination is assumed as the indoor unit, and the place to which communication of a drive-mode switching command has been sent from the indoor unit is assumed as the outdoor unit. With such an operation, communications for acquiring the device type 32 retained in each device are not necessary, so the device type indentifying means 140 can estimate the device type 32 without imposing heavy load on the network 20 and each device, and even if the network 20 or each device is under heavy load, the system structure analyzing means 160 can generate system structure information.

For the present embodiment, operations of acquiring the drive information 31*a* of each device by the drive information acquiring means 120 through the communication means 110, acquiring the device type 32 of each device by the device type indentifying means 140 through the communication means 110, and acquiring the communication destination device list 33 of each device by the communication list generating means 150 through the communication means 110 are used. However, the present embodiment is not limited to these operations, For example, operations described below may also be used. First, the air conditioning system diagnosis apparatus 100 includes a storage apparatus and the storage apparatus stores in advance the drive information 31*a*, device type 32, and communication destination device list 33 supplied from each device through the communication means 110. Then, from that storage apparatus, the drive information acquiring means 120 acquires the drive information 31*a* of each device, the device type indentifying means 140 acquires the device type 32 of each device, and the communication list generating means 150 acquires the communication destination device list 33 of each device. The configuration in which the drive information 31*a*, device type 32, and communication destination device list 33 are directly acquired through the communication means 110 and stored in the storage apparatus is used. However, the present embodiment is not limited to this configuration. A configuration in which the drive information 31*a*, device type 32, and communication destination device list 33 are stored in advance in the storage apparatus using another method and the air conditioning system diagnosis apparatus 100 does not include the communication means 110 may also be used. The information stored in the storage apparatus may be a portion of the drive information 31*a*, device type 32, and communication destination device list 33. The configuration in which the storage apparatus stores the communication destination device list 33 is used. However, the present embodiment is not limited to this configuration. A configuration in which a communication list is stored instead of the communication destination device list 33 and the communication list generating means 150 acquires the communication list from the storage apparatus may also be used. With the above-described operations, even when the air conditioning system diagnosis apparatus 100 is not connected to a target air conditioning system, a diagnosis can be performed on the air conditioning system.

For the present embodiment, an operation of outputting a system structure diagram in which the content of a refrigeration cycle diagnosis result derived by the system diagnosis means 130 using the refrigeration cycle analyzing means 131 is superimposed to the display unit 180 by the diagnosis result superimposed diagram generating means 170 is used. However, the present embodiment is not limited to this operation. For example, operations described below may also be used, First, the air conditioning system diagnosis apparatus 100 includes a storage apparatus, and the storage apparatus stores in advance a refrigeration cycle diagnosis result derived by the system diagnosis means 130 using the refrigeration cycle analyzing means 131. Then, the diagnosis result superimposed diagram generating means 170 acquires the refrigeration cycle diagnosis result from that storage apparatus and outputs a system structure diagram in which that refrigeration cycle diagnosis result is superimposed to the display unit 180. The configuration in which the storage means acquires and stores in advance a refrigeration cycle diagnosis result derived by the system diagnosis means 130 using the refrigeration cycle analyzing means 131 is used. However, a configuration in which a refrigeration cycle diagnosis result is stored in advance in the storage apparatus using another method and the system diagnosis means 130 is not included may also be used. As described in the above operations, because a refrigeration cycle diagnosis result is stored in the storage apparatus in advance, for an air conditioning system, the refrigeration cycle diagnosis result associated with the configuration of the air conditioning system can be promptly displayed.

For the present embodiment, the configuration in which the diagnosis result superimposed diagram generating means 170 generates a system structure diagram from system structure information derived by the system structure analyzing means 160 and outputs it to the display unit 180 is used. However, the present embodiment is not limited to this configuration. For example, operations described below may also be used. First, the air conditioning system diagnosis apparatus 100 includes a storage apparatus and the storage apparatus stores in advance system structure information derived by the system structure analyzing means 160. Then, the diagnosis result superimposed diagram generating means 170 acquires the system structure information from that storage apparatus, generates a system structure diagram, and outputs the system structure diagram in which the content of a refrigeration cycle diagnosis result is superimposed to the display unit 180. The configuration in which the storage means stores in advance system structure information derived by the system structure analyzing means 160 is used. However, a configuration in which system structure Information is stored in advance in the storage apparatus using another method and the system structure analyzing means 160 is not included may also be used. As described in the above operations, because system structure information is stored in the storage apparatus in advance, for an air conditioning system, a system structure diagram can be promptly generated, and a refrigeration cycle diagnosis result associated with the configuration of the air conditioning system can be displayed.

Embodiment 2

(Configuration of Air Conditioning System Diagnosis Apparatus 100)

Figure 7:
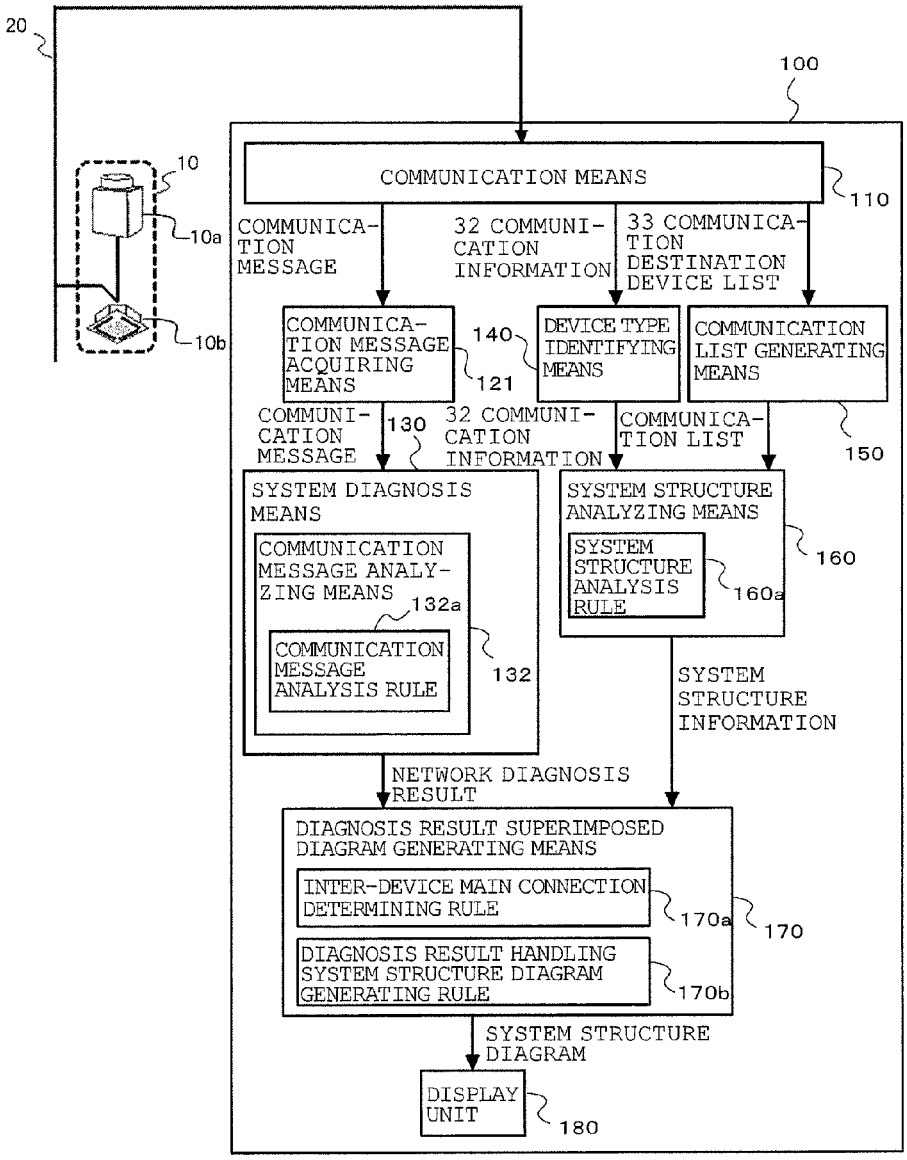
FIG. 7 illustrates an inner block of an air conditioning system diagnosis apparatus 100 and a general configuration of an air conditioning system according to Embodiment 2 of the present invention.

FIG. 7 illustrates an inner block of the air conditioning system diagnosis apparatus 100 and a general configuration of the air conditioning system according to Embodiment 2 of the present invention. A description is provided below with reference to FIG. 7, concentrating on difference from the air conditioning system diagnosis apparatus 100 according to Embodiment 1.

The air conditioning system diagnosis apparatus 100 according to the present embodiment includes at least the component groups (1) to (4), similar to that in Embodiment 1. However, the component group (2), which performs a diagnosis of a state of an air conditioning system, is different from that in Embodiment 1 in the following respects.

(2) A component group that performs a diagnosis of a state of an air conditioning system The component group (2) in Embodiment 1 has a configuration in which it includes the drive information acquiring means 120 and the system diagnosis means 130 and the system diagnosis means 130 includes the refrigeration cycle analyzing means 131. In contrast, the component group (2) in Embodiment 2 includes communication message acquiring means 121 for acquiring a communication message from the network 20 through the communication means 110. The system diagnosis means 130 include communication message analyzing means 132 for performing a diagnosis of a communication state of each device on the basis of that communication message and deriving a network diagnosis result described below. The communication message analyzing means 132 retains a communication message analysis rule 132*a* for use in deriving the above network diagnosis result.

The communication message analysis rule 132*a* may have a configuration achieved by logic on software, or alternatively, may have a configuration achieved by its equivalent circuit device or the like.

(Overview of Operation of Air Conditioning System Diagnosis Apparatus 100)

In the processing performed by the air conditioning system diagnosis apparatus 100 according to the present embodiment, step S2 is substantially the same as that in Embodiment 1; however, step S1 and step S3 are operations described below.

(Overview of Operation in System Diagnosis Step S1)

FIG. 8 illustrates an example of a normal template and an abnormal template for use in deriving the degree of similarity to a communication message. The details of an operation of step S1 are described below with reference to FIGS. 3, 7, and 8.

(S101)

The communication message acquiring means 121 in the air conditioning system diagnosis apparatus 100 acquires a communication message that contains source information, destination information of communication and the like in communication performed between devices, such as the outdoor unit 10*a*, indoor unit 10*b*, refrigerant shunt apparatus (not illustrated), and remote controller (not illustrated), from the network 20 through the communication means 110 and informs the system diagnosis means 130 of the communication message.

(S102)

The communication message analyzing means 132 in the system diagnosis means 130 sequentially derives a network diagnosis result that contains information on the presence or absence of a network failure, such as an invalid packet length, from the communication message informed by the communication message acquiring means 121 under the communication message analysis rule 132*a*.

Here, the communication message analysis rule 132*a* is a rule for determining a match between a communication message format and a message format specified by a communication protocol used in communications between the devices or determination by the degree of similarity by using comparison with a specified template.

For example, if a communication message has a configuration different from that message format, a network diagnosis result is determined as "abnormal."

Alternatively, for example, when the communication message analysis rule 132*a* includes a normal template and an abnormal template for a communication message and similarity between an acquired communication message and each of that normal template and that abnormal template is derived, if the degree of similarity to the abnormal template is higher, a network diagnosis result may be determined as "abnormal," This degree of similarity can be derived by the following method, for example. A case is discussed where the communication message analysis rule 132*a* includes normal templates 400 and 401 as the above normal template and abnormal templates 402 and 403 illustrated in FIG. 8. Each of the templates includes a template type that indicates a normal template or an abnormal template, a packet position that indicates the position of a packet in a communication message being a target of determination, a criteria value being determination criteria, and a weight to be added when determination is positive. At this time, the communication message analyzing means 132 extracts a packet at the packet position included in each template from a group of packets contained in an acquired communication message and determines whether its value is the same as the criteria value included in each template, within a range indicated by the criteria value, more than the criteria value, less than the criteria value, or the like. When the determination condition is satisfied and the template type of that template indicates a normal template, the value of its weight is added as the degree of similarity corresponding to the normal template. When the template type indicates an abnormal template, the value of its weight is added as the degree of similarity corresponding to the abnormal template. The communication message is determined on the basis of the obtained degree of similarity corresponding to the normal template and the degree of similarity corresponding to the abnormal template. For example, when the degree of similarity corresponding to the abnormal template is equal to or more than a predetermined threshold or the degree of similarity corresponding to the abnormal template is higher than that corresponding to the normal template, or the like, a network diagnosis result is determined as "abnormal."

The above-described templates are merely examples. A configuration of each template and a method of deriving the degree of similarity based on each template are not limited to the above examples.

(S103)

The system diagnosis means 130 informs the diagnosis result superimposed diagram generating means 170 of a network diagnosis result derived by the communication message analyzing means 132.

(Overview of Operation in Diagnosis Result System Structure Diagram Superimposing and Displaying Step S3)

Figure 9:
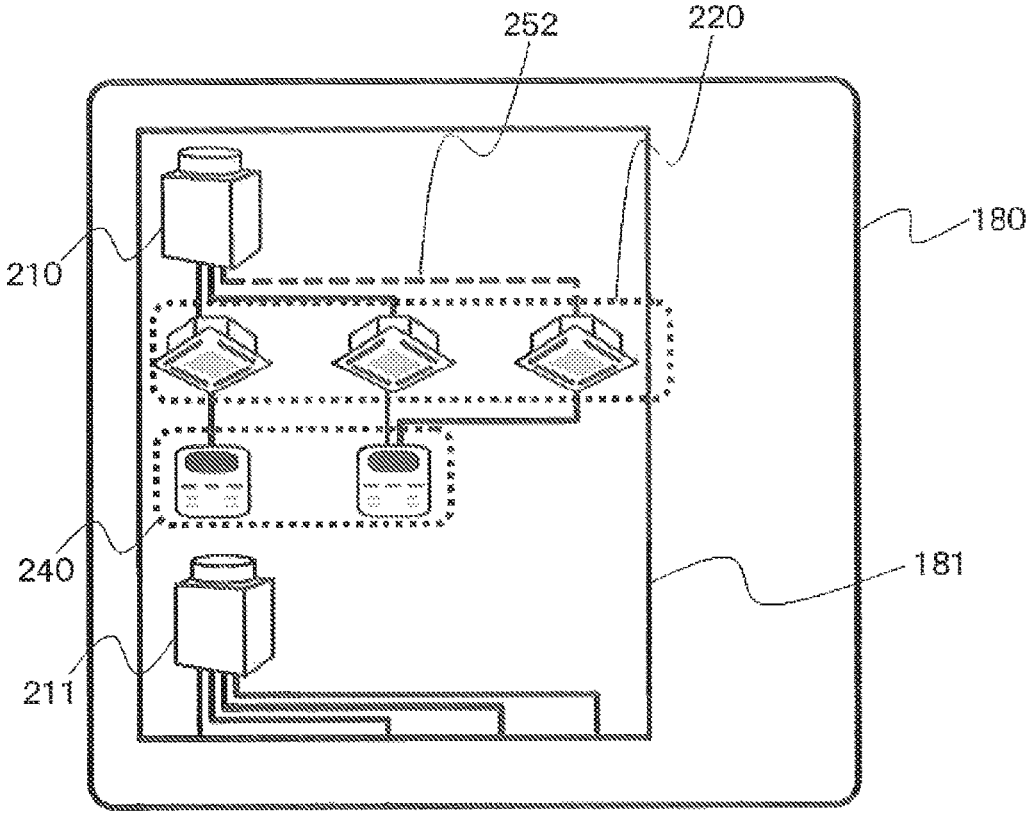
FIG. 9 illustrates a system structure diagram in which devices that transmit and receive a control signal are linked by lines, the system structure diagram being displayed on a display panel 181 of the air conditioning system diagnosis apparatus 100 according to Embodiment 2 of the present invention.

FIG. 9 illustrates a system structure diagram in which devices that transmit and receive a control signal are linked by lines, the system structure diagram being displayed on the display panel 181 of the air conditioning system diagnosis apparatus 100 according to Embodiment 2 of the present invention. The details of an operation of step S3 are described below with reference to FIGS. 3, 7, and 9.

(S301)

The diagnosis result superimposed diagram generating means 170 generates a system structure diagram that includes icons of devices and lines connecting them and the like from system structure information under the inter-device main connection determining rule 170*a*. For example, as illustrated in FIG. 9, which illustrates a system structure diagram displayed on the display panel 181 of the display unit 180 in step S303 described below, the system structure diagram is illustrated using icons that indicate device types of devices included in the air conditioning system in a distinguishable manner. As illustrated in this FIG. 9, the diagnosis result superimposed diagram generating means 170 generates a system structure diagram in which devices that transmit and receive a control signal or the like, that is, all the devices on a communication list obtained from the system structure information are linked by lines under the inter-device main connection determining rule 170*a*. Under this inter-device main connection determining rule 170*a*, for example, if the outdoor unit 10*a*, indoor units 10*b*, and remote controllers (not illustrated) are connected with each other, it is determined that transmission and reception of a control signal or the like is made between the outdoor unit 10*a* and the indoor units 10*b* and between the indoor units 10*b* and the remote controllers, and they are illustrated such that the outdoor unit icon 210 indicating the outdoor unit 10*a* and the indoor unit icons 220 indicating the indoor units 10*b* are liked by connection lines and the indoor unit icons 220 and the remote controller icons 240 indicating the remote controllers are linked by connection lines.

(S302)

The diagnosis result superimposed diagram generating means 170 superimposes, in the generated system structure diagram, the content of a network diagnosis result informed by the system diagnosis means 130 in the vicinity of a device or a group of devices related with the network diagnosis result or in the vicinity of their linking lines under the diagnosis result handling system structure diagram generating rule 170*b*. For example, if the network diagnosis result contains information that indicates detection of a failure in a communication state of devices, as illustrated in FIG. 9, which illustrates a system structure diagram displayed on the display panel 181 of the display unit 180 in step S303 described below, the system structure diagram is generated in which the connection line of a section where a failure has occurred in a communication state of the devices is highlighted. FIG. 9 illustrates a situation where a failure has occurred in a communication state between the outdoor unit 10*a* and one of the indoor units 10*b* and its connection line highlighted as an abnormal network line 252 is superimposed.

FIG. 9 illustrates merely an example of the system structure diagram and is not intended to limit Embodiment 2.

(S303)

Then the diagnosis result superimposed diagram generating means 170 outputs the system structure diagram generated from the system structure information in step S301 and in which the content of the network diagnosis result is superimposed in step S302 to the display unit 180. When receiving the system structure diagram, the display unit 180 displays that system structure diagram on the display panel 181.

(Advantageous Effects in Embodiment 2)

With the above-described configuration and operations, a communication message on a network in an air conditioning system can be acquired, the communication message can be analyzed, a failure in a communication state can be diagnosed, and thus its diagnosis result can be displayed.

If a failure in a communication state is obtained as a network diagnosis result, generating and displaying a diagram that allows all communications between devices to be individually identified visually as a system structure diagram enables the network failure location in that system structure diagram to be specifically identified visually.

For the present embodiment, operations of acquiring a communication message by the communication message acquiring means 121 through the communication means 110, acquiring the device type 32 of each device by the device type indentifying means 140 through the communication means 110, and acquiring the communication destination device list 33 of each device by the communication list generating means 150 through the communication means 110 are used. However, the present embodiment is not limited to these operations, For example, operations described below may also be used. First, the air conditioning system diagnosis apparatus 100 includes a storage apparatus, and the storage apparatus stores in advance a communication message, device type 32, and communication destination device list 33 supplied from each device through the communication means 110. Then, from that storage apparatus, the communication message acquiring means 121 acquires the communication message, the device type indentifying means 140 acquires the device type 32 of each device, and the communication list generating means 150 acquires the communication destination device list 33 of each device. The configuration in which the communication message, device type 32, and communication destination device list 33 are directly acquired through the communication means 110 and stored in the storage apparatus is used. However, the present embodiment is not limited to this configuration. A configuration in which the communication message, device type 32, and communication destination device list 33 are stored in advance in the storage apparatus using another method and the air conditioning system diagnosis apparatus 100 does not include the communication means 110 may also be used. The information stored in the storage apparatus may be a portion of the communication message, device type 32, and communication destination device list 33. The configuration in which the storage apparatus stores the communication destination device list 33 is used. However, the present embodiment is not limited to this configuration. A configuration in which a communication list is stored instead of the communication destination device list 33 and the communication list generating means 150 acquires the communication list from the storage apparatus may also be used. With the above-described operations, even when the air conditioning system diagnosis apparatus 100 is not connected to a target air conditioning system, a diagnosis can be performed on the air conditioning system.

For the present embodiment, an operation of outputting a system structure diagram in which the content of a network diagnosis result derived by the system diagnosis means 130 using the communication message analyzing means 132 is superimposed to the display unit 180 by the diagnosis result superimposed diagram generating means 170 is used. However, the present embodiment is not limited to this operation. For example, operations described below may also be used. First, the air conditioning system diagnosis apparatus 100 includes a storage apparatus, and the storage apparatus stores in advance a network diagnosis result derived by the system diagnosis means 130 using the communication message analyzing means 132. Then, the diagnosis result superimposed diagram generating means 170 acquires the network diagnosis result from that storage apparatus and outputs a system structure diagram in which that network diagnosis result is superimposed to the display unit 180. The configuration in which the storage means acquires and stores in advance a network diagnosis result derived by the system diagnosis means 130 using the communication message analyzing means 132 is used. However, a configuration in which a network diagnosis result is stored in advance in the storage apparatus using another method and the system diagnosis means 130 is not included may also be used. As described in the above operations, because a network diagnosis result is stored in the storage apparatus in advance, for an air conditioning system, the network diagnosis result associated with the configuration of the air conditioning system can be promptly displayed.

Embodiment 3

(Configuration of Air Conditioning System Diagnosis Apparatus 100)

Figure 10:
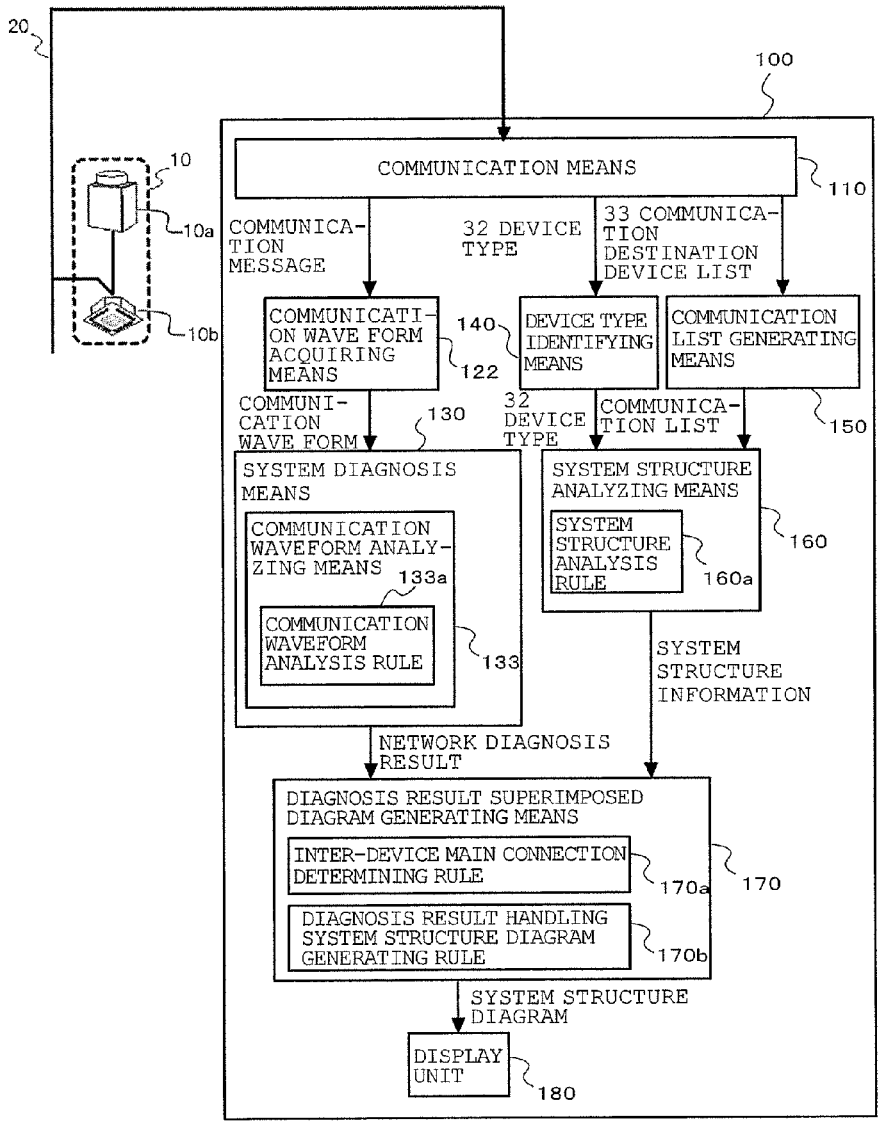
FIG. 10 illustrates an inner block of an air conditioning system diagnosis apparatus 100 and a general configuration of an air conditioning system according to Embodiment 3 of the present invention.

FIG. 10 illustrates an inner block of the air conditioning system diagnosis apparatus 100 and a general configuration of the air conditioning system according to Embodiment 3 of the present invention. A description is provided below with reference to FIG. 10, concentrating on difference from the air conditioning system diagnosis apparatus 100 according to Embodiment 1.

The air conditioning system diagnosis apparatus 100 according to the present embodiment includes at least the component groups (1) to (4), similar to that in Embodiment 1. However, the component group (2), which performs a diagnosis of a state of an air conditioning system, is different from that in Embodiment 1 in the following respects.

(2) A component group that performs a diagnosis of a state of an air conditioning system The component group (2) in Embodiment 1 has a configuration in which it includes the drive information acquiring means 120 and the system diagnosis means 130 and the system diagnosis means 130 includes the refrigeration cycle analyzing means 131. In contrast, the component group (2) in the present embodiment includes communication waveform acquiring means 122 for acquiring a communication waveform from the network 20 through the communication means 110. The system diagnosis means 130 include communication waveform analyzing means 133 for performing a diagnosis of a communication state of each device on the basis of that communication waveform and deriving a network diagnosis result described below. The communication waveform analyzing means 133 retains a communication waveform analysis rule 133*a* for use in deriving the above network diagnosis result.

The communication waveform analysis rule 133*a* may have a configuration achieved by logic on software, or alternatively, may have a configuration achieved by its equivalent circuit device or the like.

(Overview of Operation of Air Conditioning System Diagnosis Apparatus 100)

In the processing performed by the air conditioning system diagnosis apparatus 100 according to the present embodiment, step S2 and step S3 are substantially the same as those in Embodiment 1; however, step S1 is an operation described below.

(Overview of Operation in System Diagnosis Step S1)

The details of an operation of step S1 are described below with reference to FIGS. 3 and 10.

(S101)

The communication waveform acquiring means 122 in the air conditioning system diagnosis apparatus 100 acquires a communication waveform in communication performed between devices, such as the outdoor unit 10*a*, indoor unit 10*b*, refrigerant shunt apparatus (not illustrated), and remote controller (not illustrated), from the network 20 through the communication means 110 and informs the system diagnosis means 130 of the communication waveform.

(S102)

The communication waveform analyzing means 133 in the system diagnosis means 130 sequentially derives a network diagnosis result that contains information on the presence or absence of a network failure, such as a low signal level or a distorted waveform rise, from a communication waveform informed by the communication waveform acquiring means 122 under the communication waveform analysis rule 133*a*.

Here, the communication waveform analysis rule 133*a* is a rule for determining a match between a communication waveform and a proper waveform. For example, if the difference between shape characteristics of a proper waveform and those of a communication waveform, for example, the difference between signal widths, amplitudes or the like exceeds a certain threshold, a network diagnosis result is determined as "abnormal."

(S103)

The system diagnosis means 130 informs the diagnosis result superimposed diagram generating means 170 of a network diagnosis result derived by the communication waveform analyzing means 133.

(Advantageous Effects in Embodiment 3)

With the above-described configuration and operations, a communication waveform of a control signal or the like in an air conditioning system can be acquired, the communication waveform can be analyzed, a failure in a communication state can be diagnosed, and thus its diagnosis result can be displayed.

If a failure in a communication state is found in a network diagnosis result, generating and displaying a diagram that allows all communications between devices to be individually identified visually as a system structure diagram enables the network failure location in the system structure diagram to be specifically identified visually.

For the present embodiment, operations of acquiring a communication waveform by the communication waveform acquiring means 122 through the communication means 110, acquiring the device type 32 of each device by the device type indentifying means 140 through the communication means 110, and acquiring the communication destination device list 33 of each device by the communication list generating means 150 through the communication means 110 are used. However, the present embodiment is not limited to these operations. For example, operations described below may also be used. First, the air conditioning system diagnosis apparatus 100 includes a storage apparatus, and the storage apparatus stores in advance a communication waveform, device type 32, and communication destination device list 33 supplied from each device through the communication means 110. Then, from that storage apparatus, the communication waveform acquiring means 122 acquires the communication waveform, the device type indentifying means 140 acquires the device type 32 of each device, and the communication list generating means 150 acquires the communication destination device list 33 of each device. The configuration in which the communication waveform, device type 32, and communication destination device list 33 are directly acquired through the communication means 110 and stored in the storage apparatus is used. However, the present embodiment is not limited to this configuration. A configuration in which the communication waveform, device type 32, and communication destination device list 33 are stored in advance in the storage apparatus using another method and the air conditioning system diagnosis apparatus 100 does not include the communication means 110 may also be used. The information stored in the storage apparatus may be a portion of the communication waveform, device type 32, and communication destination device list 33. The configuration in which the storage apparatus stores the communication destination device list 33 is used. However, the present embodiment is not limited to this configuration. A configuration in which a communication list is stored instead of the communication destination device list 33 and the communication list generating means 150 acquires the communication list from the storage apparatus may also be used. With the above-described operations, even when the air conditioning system diagnosis apparatus 100 is not connected to a target air conditioning system, a diagnosis can be performed on the air conditioning system.

For the present embodiment, an operation of outputting a system structure diagram in which the content of a network diagnosis result derived by the system diagnosis means 130 using the communication waveform analyzing means 133 is superimposed to the display unit 180 by the diagnosis result superimposed diagram generating means 170 is used. However, the present embodiment is not limited to this operation. For example, operations described below may also be used. First, the air conditioning system diagnosis apparatus 100 includes a storage apparatus, and the storage apparatus stores in advance a network diagnosis result derived by the system diagnosis means 130 using the communication waveform analyzing means 133. Then, the diagnosis result superimposed diagram generating means 170 acquires the network diagnosis result from that storage apparatus and outputs a system structure diagram in which that network diagnosis result is superimposed to the display unit 180. The configuration in which the storage means acquires and stores in advance a network diagnosis result derived by the system diagnosis means 130 using the communication waveform analyzing means 133 is used. However, a configuration in which a network diagnosis result is stored in advance in the storage apparatus using another method and the system diagnosis means 130 is not included may also be used. As described in the above operations, because a network diagnosis result is stored in the storage apparatus in advance, for an air conditioning system, the network diagnosis result associated with the configuration of the air conditioning system can be promptly displayed.

Embodiment 4

Figure 11:
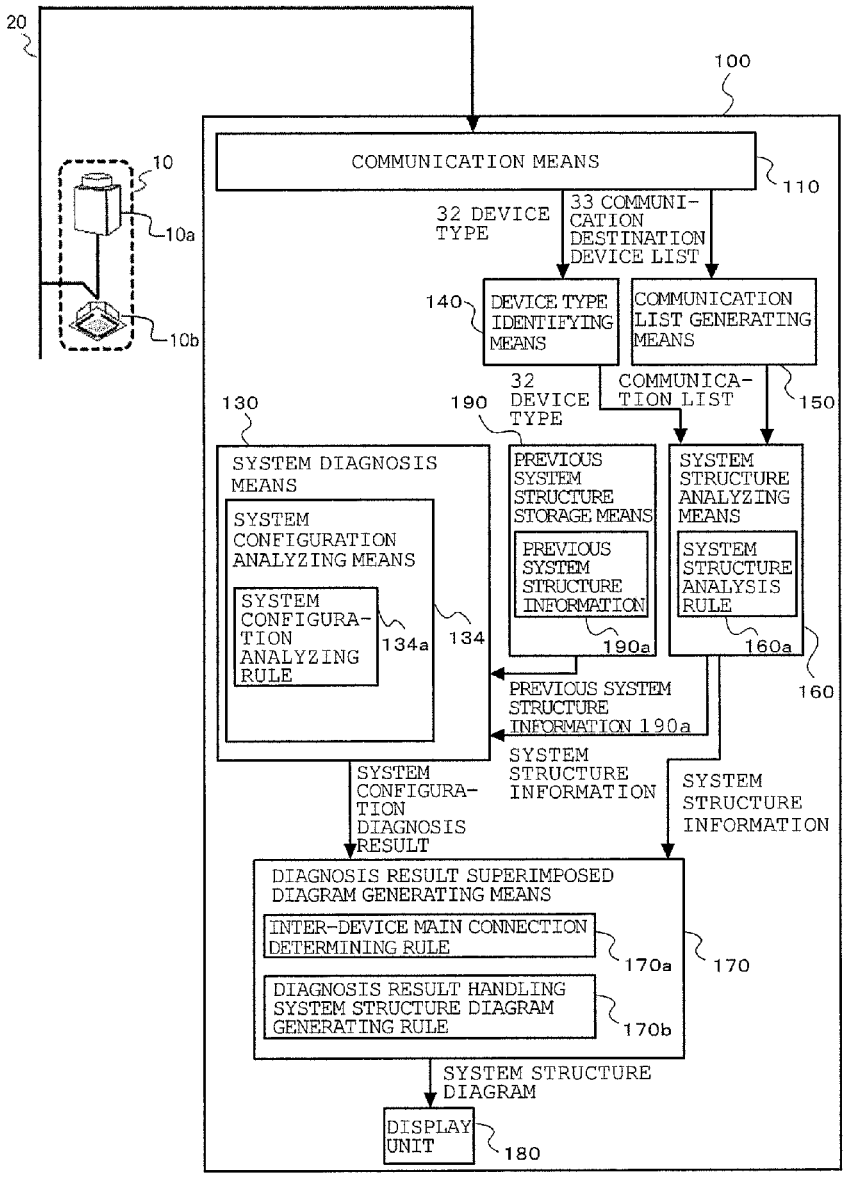
FIG. 11 illustrates an inner block of an air conditioning system diagnosis apparatus 100 and a general configuration of an air conditioning system according to Embodiment 4 of the present invention.

FIG. 11 illustrates an inner block of the air conditioning system diagnosis apparatus 100 and a general configuration of the air conditioning system according to Embodiment 4 of the present invention. A description is provided below with reference to FIG. 11, concentrating on difference from the air conditioning system diagnosis apparatus 100 according to Embodiment 1.

The air conditioning system diagnosis apparatus 100 according to the present embodiment includes at least the component groups (1) to (4), similar to that in Embodiment 1. However, the component group (2), which performs a diagnosis of a state of an air conditioning system, and the component group (3), which analyzes a system structure of an air conditioning system, are different from those in Embodiment 1 in the following respects.

(2) A component group that performs a diagnosis of a state of an air conditioning system The component group (2) in Embodiment 1 has a configuration in which it includes the drive information acquiring means 120 and the system diagnosis means 130 and the system diagnosis means 130 includes the refrigeration cycle analyzing means 131. In contrast, the component group (2) in the present embodiment includes only the system diagnosis means 130. The system diagnosis means 130 include system configuration analyzing means 134 for deriving a system configuration diagnosis result described below on the basis of system information and previous system structure information 190*a* described below. The system configuration analyzing means 134 retains a system configuration analysis rule 134*a* for use in deriving the above system configuration diagnosis result.

(3) A component group that analyzes a system structure of an air conditioning system The component group (3) in the present embodiment includes previous system structure storage means 190 in which the previous system structure information 190*a* is stored, in addition to the elements of the component group (3) in Embodiment 1.

The system configuration analysis rule 134*a* may have a configuration achieved by logic on software, or alternatively, may have a configuration achieved by its equivalent circuit device or the like.

(Overview of Operation of Air Conditioning System Diagnosis Apparatus 100)

Processing performed by the air conditioning system diagnosis apparatus 100 according to the present embodiment can be broadly classified into (S1) system diagnosis step, (S2) system structure analyzing step, and (S3) diagnosis result system structure diagram superimposing and displaying step, similar to that in Embodiment 1. The details of the operations in step S1 to step S3 are described below for each step.

(Overview of Operation in System Diagnosis Step S1)

The details of an operation of step S1 are described below with reference to FIGS. 3 and 11.

(S101)

The previous system structure storage means 190 in the air conditioning system diagnosis apparatus 100 has stored system structure information at past inspection or at the design stage of a target air conditioning system (hereinafter referred to as previous system structure information 190*a*).

(S102)

The system configuration analyzing means 134 in the system diagnosis means 130 compares system structure information derived by the system structure analyzing means 160 in step S204 described below and the previous system structure information 190*a* stored in the previous system structure storage means 190 and sequentially derives a system configuration diagnosis result that contains information on the presence or absence of a failure in the system configuration, such as detection of an unexpected device and non-detection of an expected device, under the system configuration analysis rule 134*a*.

Here, the system configuration analysis rule 134*a* is a rule for determining a match between system structure information derived by the system structure analyzing means 160 and the previous system structure information 190*a* stored in the previous system structure storage means 190. For example, if a device existing in the previous system structure information 190*a* does not exist in the system structure information or if a device that does not exist in the previous system structure information 190*a* exists in the system structure information, a system configuration diagnosis result is determined as "abnormal." Alternatively, if a connection relation of devices indicated by the previous system structure information 190*a* differs from a connection relation of devices indicated by the system structure information, a system configuration diagnosis result may also be determined as "abnormal."

(S103)

The system diagnosis means 130 informs the diagnosis result superimposed diagram generating means 170 of the system configuration diagnosis result derived by the system configuration analyzing means 134.

(Overview of Operation in System Structure Analyzing Step 62)

The details of an operation of step S2 are described below with reference to FIGS. 3 and 11.

(S201)

The device type indentifying means 140 acquires the device type 32 retained in the outdoor unit 10*a*, indoor unit 10*b*, refrigerant shunt apparatus (not illustrated), remote controller (not illustrated), or the like through the communication means 110 and informs the system structure analyzing means 160 of the device type 32.

Here, the device type 32 is information that indicates a role of each of the outdoor unit 10*a*, indoor unit 10*b*, refrigerant shunt apparatus, remote controller, and the like in the air conditioning system.

(S202)

The communication list generating means 150 acquires the communication destination device list 33 retained in the outdoor unit 10*a*, indoor unit 10*b*, refrigerant shunt apparatus (not illustrated), remote controller (not illustrated), or the like through the communication means 110, generates a communication list on the basis of that communication destination device list 33, and informs the system structure analyzing means 160 of the communication list.

Here, the communication list can be a list of combinations of source devices and destination devices, for example.

(S203)

The system structure analyzing means 160 derives system structure information containing a refrigerant structure that indicates the indoor units 10*b* and the like connected from the same outdoor unit 10*a* by a refrigerant pipeline, an interlocking relation that indicates the indoor units 10*b* and the like operating in conjunction with each other at remote control, and the like from the device type 32 acquired from the device type indentifying means 140 and the communication list acquired from the communication list generating means 150 under the system structure analysis rule 160*a*.

Here, the system structure analysis rule 160*a* is a rule for identifying a relation between devices, such as the outdoor unit 10*a*, indoor unit 10*b*, refrigerant shunt apparatus, remote controller, and the like, in an air conditioning system. For example, if an air conditioning system includes a plurality of outdoor units 10*a* and a plurality of indoor units 10*b* and the communication list has a combination of the outdoor units 10*a* and indoor units 10*b*, an outdoor unit 10*a* and an indoor unit 10*b* in combination may be identified as belonging to the same refrigerant structure. If the communication list has a plurality of combinations with different indoor units 10*b* for a single remote controller, these indoor units 10*b* may be identified as being in an interlocking relation.

(S204)

The system structure analyzing means 160 informs the diagnosis result superimposed diagram generating means 170 and the system diagnosis means 130 of the derived system structure information.

(Overview of Operation in Diagnosis Result System Structure Diagram Superimposing and Displaying Step S3)

Figure 12:
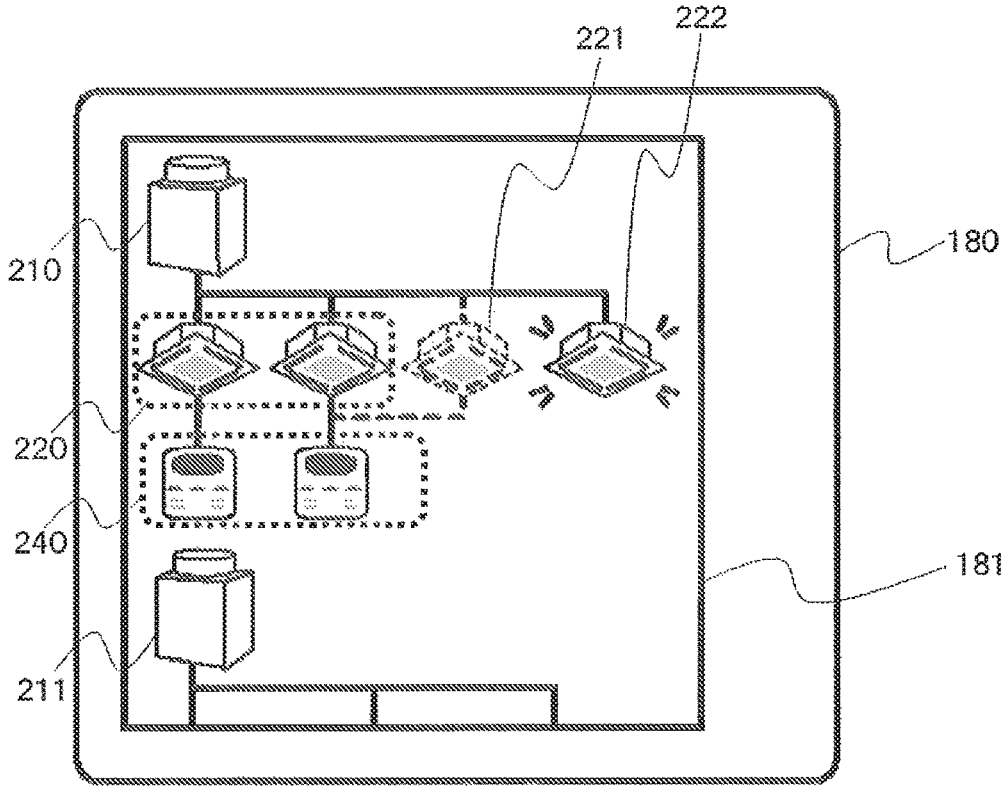
FIG. 12 is a system structure diagram that illustrates a past system configuration and a current system configuration in a distinguishable manner, the system structure diagram being displayed on a display panel 181 of the air conditioning system diagnosis apparatus 100 according to Embodiment 4 of the present invention.

FIG. 12 is a system structure diagram that illustrates a past system configuration and a current system configuration in a distinguishable manner, the system structure diagram being displayed on the display panel 181 of the air conditioning system diagnosis apparatus 100 according to Embodiment 4 of the present invention. The details of an operation of step S3 are described below with reference to FIGS. 3, 11, and 12.

(S301)

The diagnosis result superimposed diagram generating means 170 generates a system structure diagram that includes icons of devices and lines connecting them from the system structure information under the inter-device main connection determining rule 170*a*. For example, as illustrated in FIG. 12, which illustrates a system structure diagram displayed on the display panel 181 of the display unit 180 in step S303 described below, the system structure diagram is illustrated using icons that indicate device types of devices included in the air conditioning system in a distinguishable manner. First, the diagnosis result superimposed diagram generating means 170 generates a system structure diagram that illustrates a current system configuration, the system structure diagram in which devices determined from system structure information under the inter-device main connection determining rule 170*a* are linked by lines. Under this inter-device main connection determining rule 170*a*, for example, if the outdoor unit 10*a*, indoor units 10*b*, remote controllers (not illustrated) are connected with each other, it is determined that connection relations between the outdoor unit 10*a* and the indoor units 10*b* and between the indoor units 10*b* and the remote controllers are main connection relations, and they are illustrated such that the outdoor unit icon 210, which indicates the outdoor unit 10*a*, and the indoor unit icons 220, which indicate the indoor units 10*b*, are linked by connection lines and the indoor unit icons 220 and the remote controller icons 240, which indicate the remote controllers, are linked by connection lines.

(S302)

The diagnosis result superimposed diagram generating means 170 superimposes, in the system structure diagram generated from the system structure information and illustrating the current system configuration, a past configuration extracted from the system configuration diagnosis result informed by the system diagnosis means 130 under the diagnosis result handling system structure diagram generating rule 170*b*. For example, as illustrated in FIG. 12, a device detected in both the system structure information and the system configuration diagnosis result containing the content of the previous system structure information 190*a* is represented by a normal icon that indicates the type of that device. In FIG. 12, this corresponds to the outdoor unit icons 210 and 211, the indoor unit icons 220, and the remote controller icons 240. A device detected in only the system configuration diagnosis result is represented by a light-colored icon indicating the type of that device. In FIG. 12, this corresponds to a previous system structure information device icon 221. A device detected in only the system structure information is represented by a flashing icon indicating the type of that device. In FIG. 12, this corresponds to a system structure information device icon 222.

In the foregoing, in the system structure diagram, simply, a device detected in both the system structure information and the system configuration diagnosis result, a device detected in only the system configuration diagnosis result, and a device detected in only the system structure information are represented as individually distinguishable icons. However, the present embodiment is not limited to this manner. For example, when the past configuration and the current configuration are compared on the basis of the system configuration diagnosis result, if it is determined that abnormality occurs in terms of the system configuration, for example, that an unexpected device is connected or that an expected device is not connected, that device or its connection line may be represented so as to be distinguishable from a device or its connection line determined as normal in terms of the system configuration.

FIG. 12 illustrates merely an example of the system structure diagram and is not intended to limit Embodiment 4.

(S303)

Then the diagnosis result superimposed diagram generating means 170 outputs the system structure diagram generated from the system structure information in step S301 and in which the content of the system configuration diagnosis result is superimposed in step S302 to the display unit 180. When receiving the system structure diagram, the display unit 180 displays that system structure diagram on the display panel 181.

(Advantageous Effects in Embodiment 4)

With the above-described configuration and operations, a current system configuration can be analyzed from system structure information and previous system structure information, the current system configuration and a past system configuration can be compared and distinguished, they can be superimposed and displayed, and thus the location of a device insufficiently detected or the location of a device excessively detected in the current system configuration can be specifically identified visually.

Analyzing the current system configuration using the system structure information and the previous system structure information enables detecting and displaying a failure relating to a system configuration, such as a situation where an unexpected device is connected or a situation where an expected device is not connected.

For the present embodiment, an operation of outputting a system structure diagram in which the content of a system configuration diagnosis result derived by the system diagnosis means 130 using the system configuration analyzing means 134 is superimposed to the display unit 180 by the diagnosis result superimposed diagram generating means 170 is used. However, the present embodiment is not limited to this operation. For example, operations described below may also be used. First, the air conditioning system diagnosis apparatus 100 includes a storage apparatus, and the storage apparatus stores in advance a system configuration diagnosis result derived by the system diagnosis means 130 using the system configuration analyzing means 134. Then, the diagnosis result superimposed diagram generating means 170 acquires the system configuration diagnosis result from that storage apparatus and outputs a system structure diagram in which that system configuration diagnosis result is superimposed to the display unit 180. The configuration in which the storage means acquires and stores in advance a system configuration diagnosis result derived by the system diagnosis means 130 using the system configuration analyzing means 134 is used, However, a configuration in which a system configuration diagnosis result is stored in advance in the storage apparatus using another method and the system diagnosis means 130 is not included may also be used. As described in the above operations, because a system configuration diagnosis result is stored in the storage apparatus in advance, for an air conditioning system, the system configuration diagnosis result associated with the configuration of the air conditioning system can be promptly displayed.

Embodiment 5

Figure 13:
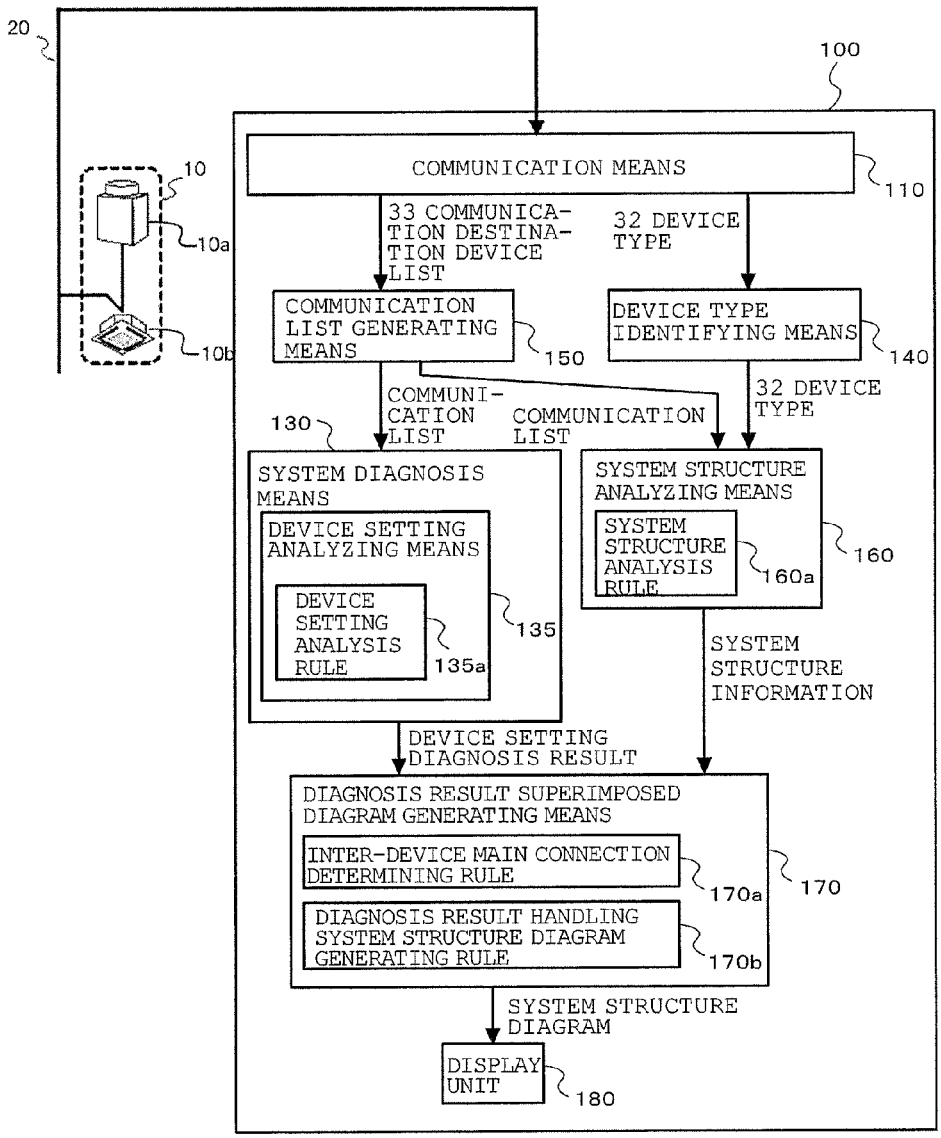
FIG. 13 illustrates an inner block of an air conditioning system diagnosis apparatus 100 and a general configuration of an air conditioning system according to Embodiment 5 of the present invention.

FIG. 13 illustrates an inner block of the air conditioning system diagnosis apparatus 100 and a general configuration of the air conditioning system according to Embodiment 5 of the present invention. A description is provided below with reference to FIG. 13, concentrating on difference from the air conditioning system diagnosis apparatus 100 according to Embodiment 1.

The air conditioning system diagnosis apparatus 100 according to the present embodiment includes at least the component groups (1) to (4), similar to that in Embodiment 1. However, the component group (2), which performs a diagnosis of a state of an air conditioning system, is different from that in Embodiment 1 in the following respects.

(2) A component group that performs a diagnosis of a state of an air conditioning system The component group (2) in Embodiment 1 has a configuration in which it includes the drive information acquiring means 120 and the system diagnosis means 130 and the system diagnosis means 130 includes the refrigeration cycle analyzing means 131. In contrast, the component group (2) in the present embodiment includes only the system diagnosis means 130. The system diagnosis means 130 include device setting analyzing means 135 for deriving a device setting diagnosis result described below on the basis of a communication list described below. The device setting analyzing means 135 retains a device setting analysis rule 135*a* for use in deriving the above device setting diagnosis result.

The device setting analysis rule 135*a* may have a configuration achieved by logic on software, or alternatively, may have a configuration achieved by its equivalent circuit device or the like.

(Overview of Operation of Air Conditioning System Diagnosis Apparatus 100)

Processing performed by the air conditioning system diagnosis apparatus 100 according to the present embodiment can be broadly classified into step S1 to step S3 described below.

(S1) System Diagnosis Step

The device setting analyzing means 135 included in the system diagnosis means 130 derives a device setting diagnosis result that contains detection of an unexpected device and non-detection of an expected device and the like determined using a device ID described below.

(S2) System Structure Analyzing Step

The device type indentifying means 140 acquires the device type 32 from the air conditioner 10 or the like through the network 20 and the communication means 110. The communication list generating means 150 acquires the communication destination device list 33 from the air conditioner 10 or the like through the network 20 and the communication means 110 and generates a communication list on the basis of that communication destination device list 33. The system structure analyzing means 160 derives system structure information containing a refrigerant structure, an interlocking relation, and the like in the air conditioning system on the basis of the device type 32 and the communication list.

(S3) Diagnosis Result System Structure Diagram Superimposing and Displaying Step The diagnosis result superimposed diagram generating means 170 generates a system structure diagram on the basis of the system structure information derived by the system structure analyzing means 160, superimposes the content of the device setting diagnosis result derived by the device setting analyzing means 135 in that system structure diagram, and outputs that system structure diagram in which the content of the device setting diagnosis result is superimposed to the display unit 180.

The details of the operations in step S1 to step S3 in FIG. 3 are described below for each step.

(Overview of Operation in System Diagnosis Step S1)

The details of an operation of step S1 are described below with reference to FIGS. 3 and 13.

(S101)

The system diagnosis means 130 in the air conditioning system diagnosis apparatus 100 acquires a communication list that includes a combination of device IDs described below from the communication list generating means 150.

(S102)

The device setting analyzing means 135 in the system diagnosis means 130 sequentially derives a device setting diagnosis result that contains information on the presence or absence of a failure in a system configuration, such as detection of an unexpected device, non-detection of an expected device, or double setting of a device ID, from the communication list informed by the communication list generating means 150 under the device setting analysis rule 135*a*.

Here, the device setting analysis rule 135*a* is a rule for determining consistency of a combination of device IDs in a communication list. For example, if a device relating to a combination of device IDs on a communication list is not a device that can perform communication, a device setting diagnosis result is determined as "abnormal." For example, if there is a combination of a single indoor unit 10*b* and two different outdoor units 10*a*, a device setting diagnosis result may also be determined as "abnormal."

(S103)

The system diagnosis means 130 informs the diagnosis result superimposed diagram generating means 170 of the device setting diagnosis result derived by the device setting analyzing means 135.

(Overview of Operation in System Structure Analyzing Step S2)

The details of an operation of step S2 are described below with reference to FIGS. 3 and 13.

(S201)

The device type indentifying means 140 acquires the device type 32 retained in the outdoor unit 10*a*, indoor unit 10*b*, refrigerant shunt apparatus (not illustrated), remote controller (not illustrated), or the like through the communication means 110 and informs the system structure analyzing means 160 of the device type 32.

Here, the device type 32 is information that indicates a role of each of the outdoor unit 10*a*, indoor unit 10*b*, refrigerant shunt apparatus, and remote controller, and the like in the air conditioning system.

(S202)

The communication list generating means 150 acquires the communication destination device list 33 containing device IDs and retained in the outdoor unit 10*a*, indoor unit 10*b*, refrigerant shunt apparatus (not illustrated), or remote controller (not illustrated) through the communication means 110, generates a communication list on the basis of that communication destination device list 33, and informs the system structure analyzing means 160 and the system diagnosis means 130 of the communication list.

Here, the communication list can be a list of combinations of source devices and destination devices having their respective device IDs, for example.

(S203)

The system structure analyzing means 160 derives system structure information containing a refrigerant structure that indicates the indoor units 10*b* and the like connected from the same outdoor unit 10*a* by a refrigerant pipeline, an interlocking relation that indicates the indoor units 10*b* and the like operating in conjunction with each other at remote control, and the like from the device type 32 acquired from the device type indentifying means 140 and the communication list acquired from the communication list generating means 150 under the system structure analysis rule 160*a*.

(S204)

The system structure analyzing means 160 informs the diagnosis result superimposed diagram generating means 170 of the derived system structure information.

(Overview of Operation in Diagnosis Result System Structure Diagram Superimposing and Displaying Step S3)

Figure 14:
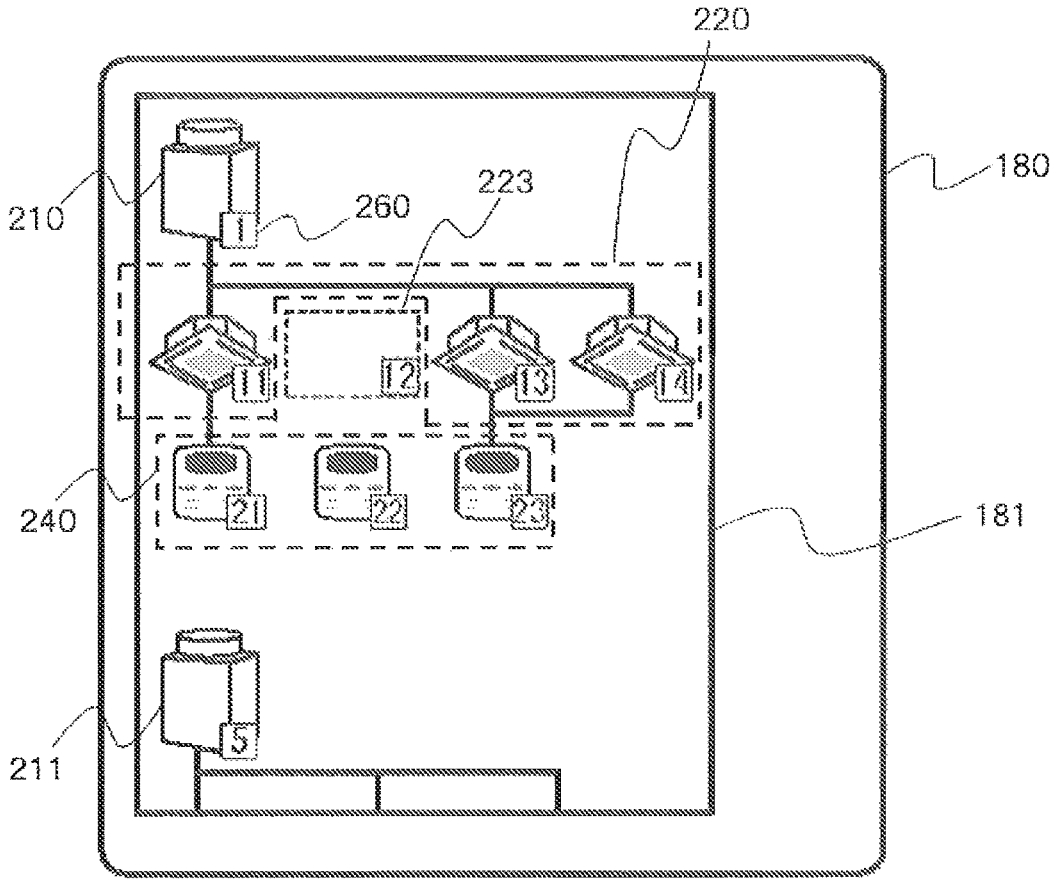
FIG. 14 illustrates a system structure diagram in which devices assigned with device IDs are linked by lines, the system structure diagram being displayed on the display panel 181 of the air conditioning system diagnosis apparatus 100 according to Embodiment 2 of the present invention.

FIG. 14 is a system structure diagram in which devices assigned with device IDs are linked by lines, the system structure diagram being displayed on the display panel 181 of the air conditioning system diagnosis apparatus 100 according to Embodiment 2 of the present invention. The details of an operation of step S3 are described below with reference to FIGS. 3, 13, and 14.

(S301)

The diagnosis result superimposed diagram generating means 170 generates a system structure diagram that includes icons of devices assigned with device IDs and lines connecting them from the system structure information under the inter-device main connection determining rule 170*a*. For example, as illustrated in FIG. 14, which illustrates a system structure diagram displayed on the display panel 181 of the display unit 180 in step S303 described below, the system structure diagram is illustrated using icons that indicate device types of devices included in the air conditioning system and using an ID displaying section 260 in a distinguishable manner. As illustrated in this FIG. 14, the diagnosis result superimposed diagram generating means 170 generates a system structure diagram in which main devices determined from devices between which a control signal or the like is transmitted and received under the inter-device main connection determining rule 170*a* are linked by lines. Under this inter-device main connection determining rule 170*a*, for example, if the outdoor unit 10*a*, indoor units 10*b*, and remote controllers (not illustrated) are connected with each other, it is determined that there are transmission and reception of a control signal or the like between the outdoor unit 10*a* and indoor units 10*b* and between the indoor units 10*b* and remote controllers, and they are illustrated such that the outdoor unit icon 210, which indicates the outdoor unit 10*a*, and the indoor unit icons 220, which indicate the indoor units 10*b*, are linked by connection lines and the indoor unit icons 220 and the remote controller icons 240, which indicate the remote controllers, are linked by connection lines. The outdoor unit icon 210, indoor unit icons 220, and remote controller icons 240 assigned with their respective device IDs are displayed.

For the above system structure diagram, the icons of the devices assigned with the device IDs may be arranged in the order of the device IDs.

(S302)

The diagnosis result superimposed diagram generating means 170 superimposes, in the generated system structure diagram, the device setting diagnosis result informed by the system diagnosis means 130 in the vicinity of a device or a group of devices related with the device setting diagnosis result or in the vicinity of their linking line under the diagnosis result handling system structure diagram generating rule 170*b*. For example, if a failure in device ID setting is detected in a device setting diagnosis result, as illustrated in FIG. 14, a missing icon relating to a device ID, that is, a missing ID icon 223 is represented by a dotted frame.

FIG. 14 illustrates merely an example of the system structure diagram and is not intended to limit Embodiment 5.

(S303)

Then the diagnosis result superimposed diagram generating means 170 outputs the system structure diagram generated from the system structure information in step S301 and in which the content of the device setting diagnosis result is superimposed in step S302 to the display unit 180. When receiving the system structure diagram, the display unit 180 displays that system structure diagram on the display panel 181.

(Advantageous Effects in Embodiment 5)

With the above-described configuration and operations, analyzing a communication list that includes a combination of device IDs by the device setting analyzing means 135 enables detection of a failure in device ID setting and displaying its detection result.

If a failure in device ID setting is found in a diagnosis result, generating a system structure diagram in which devices assigned with their respective device IDs are arranged enables the failure in device ID setting, such as missing of device ID setting, to be specifically identified visually.

For the present embodiment, an operation of outputting a system structure diagram in which the content of a device setting diagnosis result derived by the system diagnosis means 130 using the device setting analyzing means 135 is superimposed to the display unit 180 by the diagnosis result superimposed diagram generating means 170 is used. However, the present embodiment is not limited to this operation. For example, operations described below may also be used. First, the air conditioning system diagnosis apparatus 100 includes a storage apparatus, and the storage apparatus stores in advance a device setting diagnosis result derived by the system diagnosis means 130 using the device setting analyzing means 135. Then, the diagnosis result superimposed diagram generating means 170 acquires the device setting diagnosis result from that storage apparatus and outputs a system structure diagram in which that device setting diagnosis result is superimposed to the display unit 180. The configuration in which the storage means acquires and stores in advance a device setting diagnosis result derived by the system diagnosis means 130 using the device setting analyzing means 135 is used. However, a configuration in which a device setting diagnosis result is stored in advance in the storage apparatus using another method and the system diagnosis means 130 is not included may also be used. As described in the above operations, because a device setting diagnosis result is stored in the storage apparatus in advance, for an air conditioning system, the device setting diagnosis result associated with the configuration of the air conditioning system can be promptly displayed.

Embodiment 6

(Configuration of Air Conditioning System Diagnosis Apparatus 100)

In Embodiments 1 to 5, an operation occurring when the system diagnosis means 130 detects one kind of a failure is described. However, when the system diagnosis means 130 detects a plurality of kinds of failures, the diagnosis result superimposed diagram generating means 170 may generate a system structure diagram that illustrates all of the detected failures being superimposed. A description is provided below, concentrating on difference from the air conditioning system diagnosis apparatus 100 according to Embodiment 1.

For the present embodiment, the air conditioning system diagnosis apparatus 100 includes the communication message acquiring means 121 described in Embodiment 2, in addition to the drive information acquiring means 120. The system diagnosis means 130 includes the communication message analyzing means 132 described in Embodiment 2 and the system configuration analyzing means 134 described in Embodiment 4, in addition to the refrigeration cycle analyzing means 131. The air conditioning system diagnosis apparatus 100 further includes the previous system structure storage means 190 described in Embodiment 4.

(Operation of Air Conditioning System Diagnosis Apparatus 100)

Figure 15:
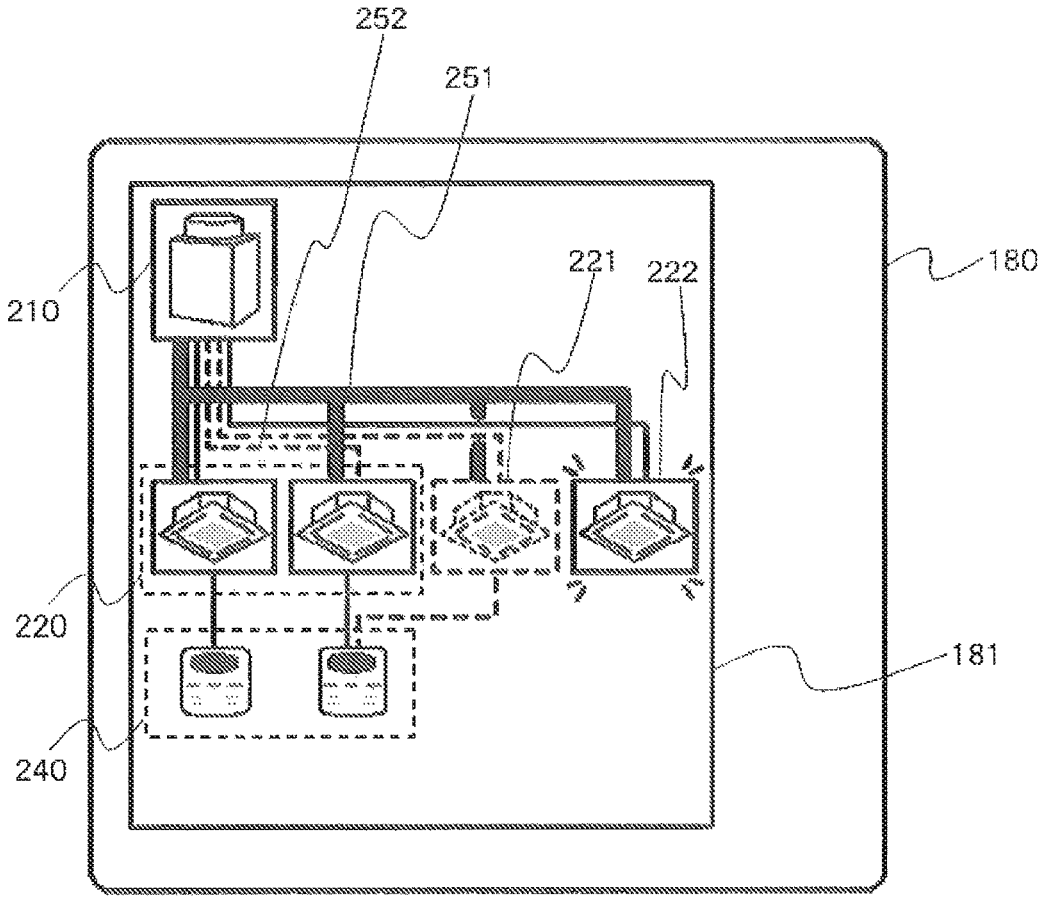
FIG. 15 illustrates a system structure diagram in which a plurality of kinds of failures are superimposed, the system structure diagram being displayed on a display panel 181 of a air conditioning system diagnosis apparatus 100 according to Embodiment 6 of the present invention.

FIG. 15 illustrates a system structure diagram in which a plurality of kinds of failures are superimposed, the system structure diagram being displayed on the display panel 181 of the air conditioning system diagnosis apparatus 100 according to Embodiment 6 of the present invention.

The refrigeration cycle analyzing means 131 derives a refrigeration cycle diagnosis result, as described in Embodiment 1, the communication message analyzing means 132 derives a network diagnosis result, as described in Embodiment 2, and the system configuration analyzing means 134 derives a system configuration diagnosis result, as described in Embodiment 4. As illustrated in FIG. 15, when a failure has been detected in any of the refrigeration cycle diagnosis result, the network diagnosis result, and the system configuration diagnosis result, the diagnosis result superimposed diagram generating means 170 generates a system structure diagram in which information indicating that failure is superimposed as an additional drawing element in a system structure diagram obtained when none of failures has been detected as a minimum drawing element.

FIG. 15 illustrates merely an example of the system structure diagram and is not intended to limit Embodiment 6.

(Advantageous Effects in Embodiment 6)

With the above-described configuration and operations, if a plurality of kinds of failures has been detected in an air conditioning system, generating a system structure diagram that contains an additional drawing element corresponding to each of the failures enables the relation between the plurality of kinds of failures and the system configuration to be easily identified visually.

For the present embodiment, the system diagnosis means 130 includes the refrigeration cycle analyzing means 131, communication message analyzing means 132, and system configuration analyzing means 134. However, the present embodiment is not limited to this configuration. The system diagnosis means 130 may further include the communication waveform acquiring means 122 and communication waveform analyzing means 133 described in Embodiment 3 and the device setting analyzing means 135 described in Embodiment 5, or alternatively, may include a portion of these elements.

For the present embodiment, an operation of generating a system structure diagram that illustrates all of a plurality of kinds of failures detected by the system diagnosis means 130 by the diagnosis result superimposed diagram generating means 170 is used. However, the present embodiment is not limited to this operation. An operation of generating a system structure diagram that illustrates only one or more kinds of failures selected by a user may also be used. With this, although the number of drawing elements in a system structure diagram increases with an increase in the number of kinds of failures, complexity of the system structure diagram can be reduced by restricting displaying to only a failure on which a user places importance, and the relation between the failure and the system configuration can be easily identified visually.

Embodiment 7

Figure 16:
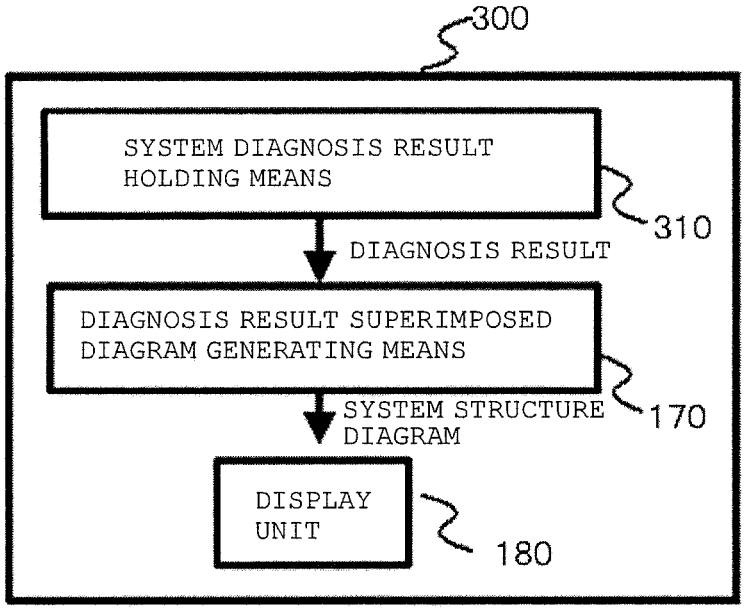
FIG. 16 is a block diagram that illustrates a configuration of an air conditioning system diagnosis result display apparatus 300 according to Embodiment 7 of the present invention.

FIG. 16 is a block diagram that illustrates a configuration of an air conditioning system diagnosis result display apparatus 300 according to Embodiment 7 of the present invention.

(Configuration of Air Conditioning System Diagnosis Result Display Apparatus 300)

As illustrated in FIG. 16, the air conditioning system diagnosis result display apparatus 300 includes system diagnosis result holding means 310, the diagnosis result superimposed diagram generating means 170, and the display unit 180. The display unit 180 includes the display panel 181, as illustrated in FIG. 17 described below.

(Operation of Air Conditioning System Diagnosis Result Display Apparatus 300)

Figure 17:
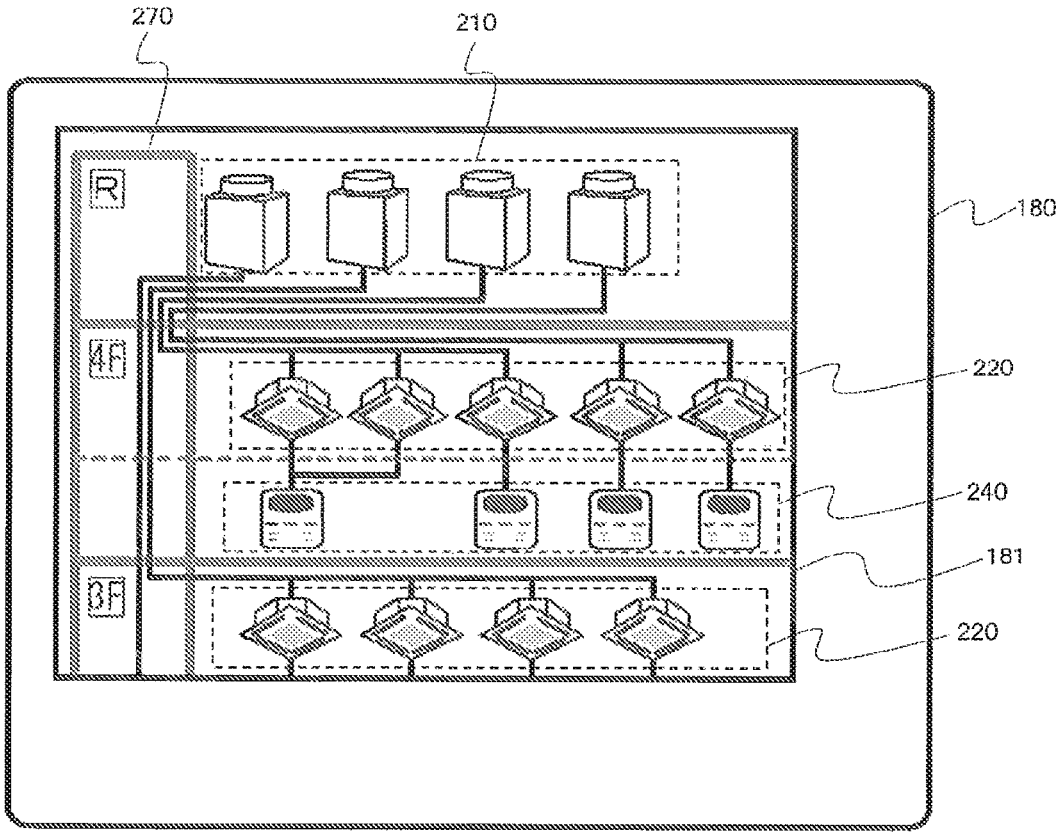
FIG. 17 illustrates an example of a system structure diagram displayed on a display panel 181 of the air conditioning system diagnosis result display apparatus 300 according to Embodiment 7 of the present invention.

FIG. 17 illustrates an example of a system structure diagram displayed on the display panel 181 of the air conditioning system diagnosis result display apparatus 300 according to Embodiment 7 of the present invention.

The system diagnosis result holding means 310 holds a diagnosis result for an air conditioning system being a target of a diagnosis and informs the diagnosis result superimposed diagram generating means 170 of the diagnosis result.

Here, examples of the diagnosis result can include a refrigeration cycle diagnosis result derived by the refrigeration cycle analyzing means 131 described in Embodiment 1, a network diagnosis result derived by each of the communication message analyzing means 132 described in Embodiment 2 and the communication waveform analyzing means 133 disclosed in Embodiment 3, a system configuration diagnosis result derived by the system configuration analyzing means 134 described in Embodiment 4, and a device setting diagnosis result derived by the device setting analyzing means 135 described in Embodiment 5. Any diagnosis result may be used as long as the system diagnosis result holding means 310 can acquire the diagnosis result from any of the above analyzing means and hold it.

The diagnosis result is not limited to the above-described examples. For instance, if each of the devices included in an air conditioning system has the function of diagnosing a failure, a diagnosis result may be acquired through the communication means, or alternatively, may be acquired from a storage apparatus in which the above diagnosis result has been previously stored. Alternatively, a diagnosis result may be acquired from inputting means capable of receiving an entry, such as system installation information, from a user.

The diagnosis result superimposed diagram generating means 170 generates a system structure diagram of an air conditioning system on the basis of a diagnosis result held by the system diagnosis result holding means 310, superimposes information relating to the diagnosis result in that system structure diagram such that the information is highlighted, and outputs the system structure diagram to the display unit 180.

The display unit 180 displays, on the display panel 181, the system structure diagram in which the content of the diagnosis result is superimposed output by the diagnosis result superimposed diagram generating means 170. This system structure diagram may also be a diagram that illustrates the location of each device in a building, as illustrated in FIG. 17, for example. In this case, a diagram that schematically illustrates the location of each device, for example, illustrates outdoor units on a rooftop and indoor units inside a building, for example. In FIG. 17, the outdoor unit icons 210, which indicate outdoor units, are illustrated at a rooftop section in a building displaying section 270, and the indoor unit icons 220, which indicate indoor units, and the remote controller icons 240, which indicate remote controllers, are illustrated at each floor section inside the building.

FIG. 17 illustrates merely an example of a system structure diagram and thus is not intended to limit a displayed layout of the system structure diagram. For example, a system structure diagram suited for a diagnosis result may be generated by changing the granularity of each the displayed icons indicating devices for, for example, each floor or each room of a building in response to a diagnosis result.

The diagnosis result superimposed diagram generating means 170 generates a system structure diagram illustrated in FIG. 17. However, the present embodiment is not limited to this manner. The diagnosis result superimposed diagram generating means 170 may generate a schematic diagram that represents an air conditioning system while widely highlighting information on a diagnosis result, for example, a device arrangement diagram in which connection lines connecting the devices in FIG. 17 are removed and arrangement of the devices are illustrated.

(Advantageous Effects in Embodiment 7)

With the above-described configuration and operations, generating a system structure diagram of an air conditioning system in response to a diagnosis result for the air conditioning system and superimposing and illustrating the diagnosis result enables the relation between the diagnosis result for the air conditioning system and the system configuration to be easily identified visually.

With this, action, such as a repair, can be speedily performed, and thus a trouble can be solved early.

INDUSTRIAL APPLICABILITY

One example of an application of the present invention can be a device driving abnormality analyzing tool for use in a building equipment management system that includes an air conditioning device and an illumination device. Because a refrigeration cycle of an air conditioning device and a failure in an air conditioning system in a network between devices can be displayed in a readily understandable manner, a failure, for example, aging degradation of the air conditioning device, can be early found, and measures can be carried out.

REFERENCE SIGNS LIST

10 air conditioner, 10*a* outdoor unit, 10*b* indoor unit, 20 network, 30 communication means, 31 drive information generating means, 31*a* drive information, 32 device type, 33 communication destination device list, 100 air conditioning system diagnosis apparatus, 110 communication means, 120 drive information acquiring means, 121 communication message acquiring means, 122 communication waveform acquiring means, 130 system diagnosis means, 131 refrigeration cycle analyzing means, 131*a* refrigeration cycle analysis rule, 132 communication message analyzing means, 132*a* communication message analysis rule, 133 communication waveform analyzing means, 133*a* communication waveform analysis rule, 134 system configuration analyzing means, 134*a* system configuration analysis rule, 135 device setting analyzing means, 135*a* device setting analysis rule, 140 device type indentifying means, 150 communication list generating means, 160 system structure analyzing means, 160*a* system structure analysis rule, 170 diagnosis result superimposed diagram generating means, 170*a* inter-device main connection determining rule, 170*b* diagnosis result handling system structure diagram generating rule, 180 display unit, 181 display panel, 190 previous system structure storage means, 190*a* previous system structure information, 210, 211 outdoor unit icon, 215 insufficient refrigerant displaying section, 220 indoor unit icon, 221 previous system structure information device icon, 222 system structure information device icon, 223 missing ID icon, 230 refrigerant shunt apparatus icon, 240 remote controller icon, 250, 251, 251*a* connection line, 252 abnormal network line, 260 ID displaying section, 270 building displaying section, 300 air conditioning system diagnosis result display apparatus, 310 system diagnosis result holding means, 400, 401 normal template, 402, 403 abnormal template

The invention claimed is:

1. An air conditioning system diagnosis apparatus comprising:

communication means for, in an air conditioning system in which a plurality of devices are connected by a network and the related devices transmit and receive a control signal to and from each other over the network, performing communication between the devices over the network;

device type identifying means for identifying a device type that indicates a type of each device;

communication list generating means for generating a communication list that includes a combination of the devices being a communication source and a communication destination of the control signal;

system structure analyzing means for deriving system structure information that indicates a device configuration of the air conditioning system from the device type and the communication list;

system diagnosis means for performing a diagnosis on the air conditioning system using information acquired through the communication means and deriving a diagnosis result;

diagnosis result superimposed diagram generating means for generating a system structure diagram on the basis of the system structure information acquired from the system structure analyzing means and superimposing a highlighted content of the diagnosis result in the system structure diagram; and a display unit that acquires the system structure diagram in which the content of the diagnosis result is superimposed from the diagnosis result superimposed diagram generating means and displaying the system structure diagram.

2. The air conditioning system diagnosis apparatus of claim 1, wherein each of the devices has a communication destination device list being a list of communication destination devices for the control signal, and the communication list generating means acquires the communication destination device list from the device through the communication means and generates the communication list on the basis of the communication destination device list.

3. The air conditioning system diagnosis apparatus of claim 1, wherein each device has the device type, and the device type identifying means acquires the device type from the device through the communication means.

4. The air conditioning system diagnosis apparatus of claim 1, wherein the diagnosis result superimposed diagram generating means includes an inter-device main connection determining rule, depicts each device as a different icon for each device type, selects main devices from among the devices that transmit and receive the control signal on the basis of the inter-device main connection determining rule, links the devices with each other by lines, and generates the system structure diagram.

5. The air conditioning system diagnosis apparatus of claim 1, further comprising drive information acquiring means for acquiring drive information, such as a refrigerant temperature value or a refrigerant pressure value in a refrigeration cycle of each device, from the device through the communication means, wherein the system diagnosis means includes refrigeration cycle analyzing means for:

acquiring the drive information from the drive information acquiring means;

diagnosing a presence or absence of abnormality in a refrigerant temperature, a refrigerant pressure in the refrigeration cycle on the basis of the drive information; detecting a presence or absence of a failure in the refrigeration cycle; and deriving a refrigeration cycle diagnosis result as the diagnosis result.

6. The air conditioning system diagnosis apparatus of claim 5, wherein the diagnosis result superimposed diagram generating means acquires the refrigeration cycle diagnosis result from the system diagnosis means and superimposes highlight of an indoor unit and an outdoor unit linked by a refrigerant pipeline that connects an indoor unit and/or an outdoor unit in which a failure has been detected in a refrigeration cycle and highlight of the refrigerant pipeline onto the system structure diagram on the basis of the refrigeration cycle diagnosis result.

7. The air conditioning system diagnosis apparatus of claim 1, further comprising communication message acquiring means for acquiring a communication message in the communication performed between the devices from the network through the communication means, wherein the system diagnosis means includes communication message analyzing means for acquiring the communication message from the communication message acquiring means, detecting a presence or absence of a failure in the network from the communication message and deriving a network diagnosis result as the diagnosis result.

8. The air conditioning system diagnosis apparatus of claim 1, further comprising communication waveform acquiring means for acquiring a communication waveform in the communication performed between the devices from the network through the communication means, wherein the system diagnosis means includes communication waveform analyzing means for acquiring the communication waveform from the communication waveform acquiring means and detecting a presence or absence of a failure in the network using a difference between the communication waveform and a predetermined proper waveform and deriving a network diagnosis result as the diagnosis result.

9. The air conditioning system diagnosis apparatus of claim 7, wherein the diagnosis result superimposed diagram generating means generates the system structure diagram represented by linking all of the devices on the communication list to each other on the basis of the system structure information, acquires the network diagnosis result from the system diagnosis means and superimposes highlight of a device related with the presence or absence of the failure in the network, a linking line that links the device onto the system structure diagram on the basis of the network diagnosis result.

10. The air conditioning system diagnosis apparatus of claim 1, further comprising previous system structure storage means for storing previous system structure information that indicates a past device configuration in the air conditioning system, wherein the system diagnosis means includes system configuration analyzing means for acquiring the previous system structure information from the previous system structure storage means, comparing the system structure information and the previous system structure information, detecting a presence or absence of a failure in a system configuration and deriving a system configuration diagnosis result as the diagnosis result.

11. The air conditioning system diagnosis apparatus of claim 10, wherein the diagnosis result superimposed diagram generating means acquires the system configuration diagnosis result from the system diagnosis means and superimposes different representations of a device in the system configuration contained in both the system structure information and the system configuration diagnosis result containing a content of the previous system structure information, a device in the system configuration contained in only the system configuration diagnosis result, and a device in the system configuration contained in only the system structure information onto the system structure diagram.

12. The air conditioning system diagnosis apparatus of claim 1, wherein the communication list generating means generates the communication list including a combination of device IDs of the devices as a combination of the devices, the system diagnosis means includes device setting analyzing means for acquiring the communication list from the communication list generating means, detecting a presence or absence of a failure in setting of the device IDs from the communication list and deriving a device setting diagnosis result as the diagnosis result.

13. The air conditioning system diagnosis apparatus of claim 12, wherein the diagnosis result superimposed diagram generating means acquires the device setting diagnosis result from the system diagnosis means, generates the system structure diagram in which the device ID is assigned to each of the devices on the basis of the system structure information and superimposes the device setting diagnosis result onto the system structure diagram.

14. The air conditioning system diagnosis apparatus of claim 1, comprising two or more means out of drive information acquiring means for acquiring drive information, such as a refrigerant temperature value or a refrigerant pressure value in a refrigeration cycle of the devices, from the devices through the communication means, communication message acquiring means for acquiring a communication message in the communication performed between the devices from the network through the communication means, communication waveform acquiring means for acquiring a communication waveform in the communication performed between the devices from the network through the communication means, previous system structure storage means for storing previous system structure information that indicates a past device configuration in the air conditioning system, and the communication list generating means for generating the communication list including a combination of device IDs of devices as a combination of the devices, wherein:

when the drive information acquiring means is included, the system diagnosis means includes refrigeration cycle analyzing means for acquiring the drive information from the drive information acquiring means, diagnosing a presence or absence of abnormality in a refrigerant temperature, a refrigerant pressure in the refrigeration cycle on the basis of the drive information, detecting a presence or absence of a failure in the refrigeration cycle and deriving a refrigeration cycle diagnosis result as the diagnosis result, when the communication message acquiring means is included, the system diagnosis means includes communication message analyzing means for acquiring the communication message from the communication message acquiring means, detecting a presence or absence of a failure in the network from the communication message and deriving a network diagnosis result as the diagnosis result;

when the communication waveform acquiring means is included, the system diagnosis means includes communication waveform analyzing means for acquiring the communication waveform from the communication waveform acquiring means, detecting a presence or absence of a failure in the network using a difference between the communication waveform and a predetermined proper waveform, and deriving a network diagnosis result as the diagnosis result, when the previous system structure storage means is included, the system diagnosis means includes system configuration analyzing means for acquiring the previous system structure information from the previous system structure storage means, comparing the system structure information and the previous system structure information, detecting a presence or absence of a failure in a system configuration and deriving a system configuration diagnosis result as the diagnosis result;

when the communication list generating means generates the communication list including the combination of the device IDs of the devices as the combination of the devices, the system diagnosis means includes device setting analyzing means for acquiring the communication list from the communication list generating means, detecting a presence or absence of a failure in setting of the device IDs from the communication list, and deriving a device setting diagnosis result as the diagnosis result; and the diagnosis result superimposed diagram generating means generates the diagram for all information as an additional drawing element, which indicates a failure when the failure has been detected in any of the diagnosis results, so as to be superimposed and illustrated onto the system structure diagram when no failure had been detected in the diagnosis results.

15. An air conditioning system diagnosis result display apparatus comprising:

system diagnosis result holding means for, in an air conditioning system that includes a plurality of devices, holding a diagnosis result for the air conditioning system;

diagnosis result superimposed diagram generating means for acquiring the diagnosis result from the system diagnosis result holding means, generating a schematic diagram that illustrates the air conditioning system on the basis of the diagnosis result, and superimposing information relating to the diagnosis result onto the schematic diagram such that the information relating to the diagnosis result is highlighted; and a display unit acquiring the schematic diagram on which the diagnosis result is superimposed from the diagnosis result superimposed diagram generating means and displaying the schematic diagram.

* * * * *